US007497646B2

(12) United States Patent
Price

(10) Patent No.: US 7,497,646 B2
(45) Date of Patent: Mar. 3, 2009

(54) EXTENDED WIDTH RETAINING WALL BLOCK

(75) Inventor: Brian A. Price, Rochester, MN (US)

(73) Assignee: Mortarless Technologies LLC, Rochester, MN (US)

( * ) Notice: Subject to any disclaimer, the term of this patent is extended or adjusted under 35 U.S.C. 154(b) by 0 days.

(21) Appl. No.: 11/405,379

(22) Filed: Apr. 17, 2006

(65) Prior Publication Data

US 2006/0179780 A1 Aug. 17, 2006

Related U.S. Application Data

(63) Continuation-in-part of application No. 11/271,223, filed on Nov. 12, 2005.

(60) Provisional application No. 60/673,946, filed on Apr. 22, 2005, provisional application No. 60/707,496, filed on Aug. 11, 2005, provisional application No. 60/627,360, filed on Nov. 12, 2004.

(51) Int. Cl.
*E04C 2/04* (2006.01)

(52) U.S. Cl. ..... 405/284; 52/603; 52/604; 52/605; 52/609

(58) Field of Classification Search ..... 52/604, 52/606, 608, 611; 405/284, 286
See application file for complete search history.

(56) References Cited

U.S. PATENT DOCUMENTS

| | | | |
|---|---|---|---|
| 751,346 | A | 2/1904 | Schall |
| 1,260,024 | A | 3/1918 | Parton |
| 1,526,730 | A | 2/1925 | Zottoli |
| 1,727,362 | A | 9/1929 | Bone |
| 1,762,343 | A | 6/1930 | Munster |
| 1,795,451 | A | 3/1931 | Sharpe |
| 1,816,916 | A | 8/1931 | Sentrop |
| 3,686,873 | A | 8/1972 | Vidal |
| 4,068,482 | A | 1/1978 | Hilfiker |
| 4,123,881 | A | 11/1978 | Muse |
| 4,154,554 | A | 5/1979 | Hilfiker |
| 4,207,718 | A | 6/1980 | Schaaf et al. |
| 4,266,890 | A | 5/1981 | Hilfiker |
| 4,324,508 | A | 4/1982 | Hilfiker et al. |
| 4,343,572 | A | 8/1982 | Hilfiker |
| 4,391,557 | A | 7/1983 | Hilfiker et al. |
| 4,470,728 | A | 9/1984 | Broadbent |

(Continued)

OTHER PUBLICATIONS

Brochure, Keysystem 1, Retaining Wall System, copyrighted 2000, pp. 1-8.

(Continued)

*Primary Examiner*—Tara L. Mayo
(74) *Attorney, Agent, or Firm*—Patterson, Thuente, Skaar & Christensen, P.A.

(57) ABSTRACT

A retaining wall block engagement system comprises a plurality of wall blocks connected with connectors. Each wall block comprises a top surface and opposing bottom surface, a front surface and opposing rear surface and first and second opposing side surfaces. Each side surface includes a shoulder portion and a pair of recesses extending upwardly from bottom surface. The recesses separated by a web portion. A plurality of generally H-shaped or h-shaped connectors are configured to interlock a block in a given course with a block in an adjacent course of blocks.

8 Claims, 16 Drawing Sheets

U.S. PATENT DOCUMENTS

| | | | | |
|---|---|---|---|---|
| 4,592,678 | A | | 6/1986 | McNinch, Jr. et al. |
| 4,909,010 | A | | 3/1990 | Gravier |
| 4,914,876 | A | | 4/1990 | Forsberg |
| 4,920,712 | A | | 5/1990 | Dean, Jr. |
| 4,968,186 | A | | 11/1990 | Ogorchock |
| D317,048 | S | | 5/1991 | Forsberg |
| 5,044,834 | A | | 9/1991 | Janopaul, Jr. |
| 5,046,898 | A | | 9/1991 | McKinney |
| 5,064,313 | A | | 11/1991 | Risi et al. |
| 5,145,288 | A | | 9/1992 | Borcherdt |
| 5,163,261 | A | | 11/1992 | O'Neill |
| 5,259,704 | A | | 11/1993 | Orgorchock |
| 5,337,527 | A | | 8/1994 | Wagenaar |
| 5,451,120 | A | | 9/1995 | Martinez-Gonzalez |
| 5,456,554 | A | | 10/1995 | Barrett et al. |
| 5,474,405 | A | | 12/1995 | Anderson et al. |
| 5,484,235 | A | | 1/1996 | Hilfiker et al. |
| 5,505,034 | A | | 4/1996 | Dueck |
| 5,511,910 | A | | 4/1996 | Scales |
| 5,525,015 | A | | 6/1996 | Morimoto et al. |
| 5,540,525 | A | | 7/1996 | Miller et al. |
| 5,551,809 | A | | 9/1996 | Forsberg |
| 5,622,456 | A | | 4/1997 | Risi et al. |
| 5,647,185 | A | | 7/1997 | Forlini |
| 5,653,558 | A | | 8/1997 | Price |
| 5,673,530 | A | | 10/1997 | Bailey, II |
| 5,704,183 | A | | 1/1998 | Woolford |
| 5,800,095 | A | | 9/1998 | Egan |
| 5,816,749 | A | * | 10/1998 | Bailey, II ..... 405/286 |
| 5,823,709 | A | | 10/1998 | Maher et al. |
| 5,827,015 | A | | 10/1998 | Woolford et al. |
| D403,437 | S | | 12/1998 | Rise et al. |
| D405,193 | S | | 2/1999 | Scales |
| D405,543 | S | | 2/1999 | Shillingburg |
| 5,913,790 | A | | 6/1999 | Dawson |
| 5,951,210 | A | | 9/1999 | Maguire et al. |
| 6,086,288 | A | | 7/2000 | Ruel et al. |
| 6,113,318 | A | | 9/2000 | Guth |
| 6,168,353 | B1 | | 1/2001 | Price |
| RE37,278 | E | | 7/2001 | Forsberg |
| 6,287,054 | B1 | * | 9/2001 | Egan et al. ..... 405/262 |
| 6,336,773 | B1 | | 1/2002 | Anderson et al. |
| D459,487 | S | | 6/2002 | Bott |
| D466,229 | S | | 11/2002 | Risi et al. |
| 6,474,036 | B2 | | 11/2002 | Martin et al. |
| 6,536,994 | B2 | | 3/2003 | Race |
| D479,342 | S | | 9/2003 | Dawson |
| 6,615,561 | B2 | | 9/2003 | MacDonald |
| 6,622,445 | B1 | | 9/2003 | Shillingburg et al. |
| 6,651,401 | B2 | | 11/2003 | Price et al. |
| 6,652,197 | B2 | | 11/2003 | Shaw |
| D485,371 | S | | 1/2004 | Burgess et al. |
| 6,675,547 | B1 | | 1/2004 | Golcheh |
| 6,792,731 | B2 | | 9/2004 | Bott et al. |
| D497,399 | S | | 10/2004 | May et al. |
| 6,808,339 | B2 | | 10/2004 | Peterson et al. |
| 6,821,058 | B1 | | 11/2004 | Dawson |
| D501,935 | S | | 2/2005 | Dawson et al. |
| 7,059,808 | B2 | | 6/2006 | Risi |
| 7,096,635 | B2 | | 8/2006 | Price et al. |
| D530,832 | S | | 10/2006 | Rainey |
| 2005/0016106 | A1 | | 1/2005 | Dawson et al. |
| 2006/0101770 | A1 | | 5/2006 | Price |
| 2006/0110222 | A1 | | 5/2006 | Price |

OTHER PUBLICATIONS

Case Study, Water Application, Keystone Retaining Wall System, Upper Cumberland River Flood Project, copyrighted 2000, pp. 1-4.
Case Study, Governmental Application, Keystone Retaining Wall System, Port of Seattle Terminal #5 & SW Harbor Reclamation, copyrighted 2000, pp. 1-4.
Keystone, Retaining Wall System, *The First to Last*, copyrighted 1997, pp. 1-19.
"Classic" product literature, Rockwood Retaining Walls, 12 pgs., 1997.
International Search Report.
Office Action dated Nov. 30, 2006, 8 pages.
Office Action dated Jun. 6, 2006, 14 pages.

* cited by examiner

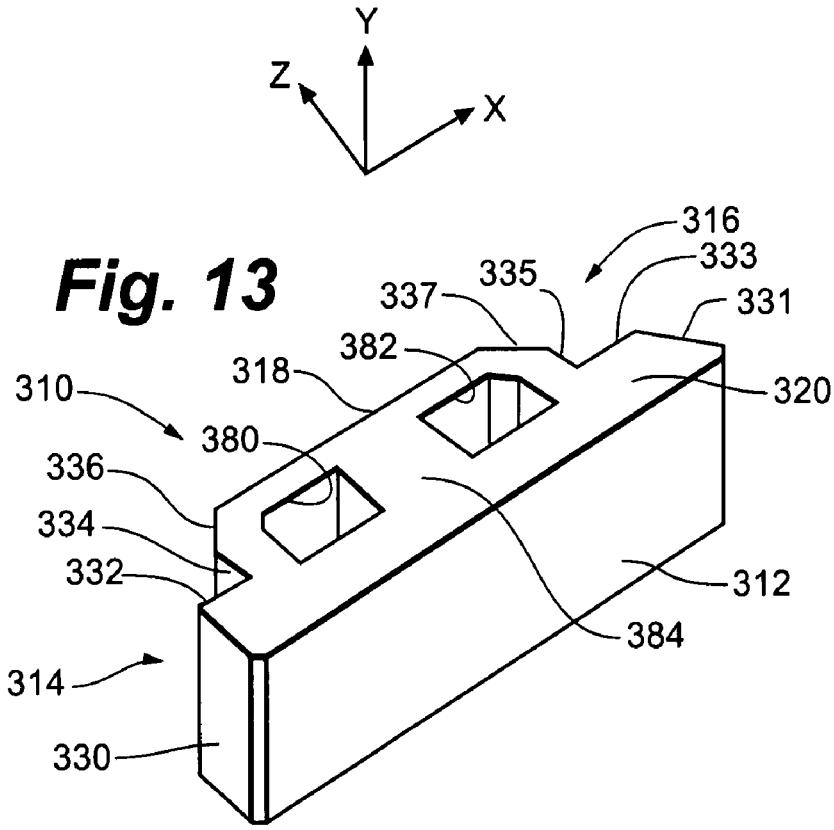
Fig. 13
Fig. 14
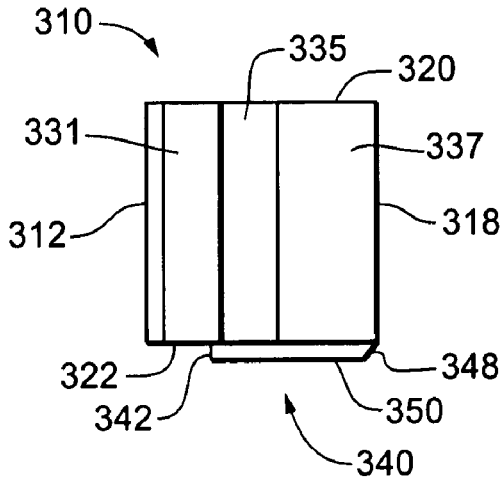

EXTENDED WIDTH RETAINING WALL BLOCK

RELATED APPLICATIONS

This application claims priority from Provisional Application Ser. No. 60/673,946 filed Apr. 22, 2005 and Provisional Application Ser. No. 60/707,496 filed Aug. 11, 2005. This application is also a continuation-in-part of Application No. 11/271,223 filed Nov. 12, 2005, which claims priority from Provisional Application Ser. No. 60/627,360 filed Nov. 12, 2004, Provisional Application Ser. No. 60/673,946 filed Apr. 22, 2005, and Provisional Application Ser. No. 60/707,496 filed Aug. 11, 2005. The entirety of each of the above-referenced applications is hereby incorporated by reference herein.

FIELD OF THE INVENTION

This invention relates generally to retaining walls. More particularly, the present invention relates to manufactured blocks that are used to construct mortarless retaining walls.

BACKGROUND OF THE INVENTION

Retaining walls can be both functional and decorative and range from small gardening applications to large-scale construction projects. Such walls are typically used to facilitate the formation of horizontal surface areas by providing a generally vertical barrier behind which backfill may be deposited. Such walls can also be used to reduce erosion and slumping in embankments. Retaining walls can be constructed of a variety of materials having a variety of shapes. Some retaining walls have been constructed from wood timbers, while others have been constructed of manufactured concrete blocks. A drawback to existing concrete retaining wall blocks is that production, shipping, and installation is limited due to their size.

SUMMARY OF THE INVENTION

A retaining wall block that may be used with an earth anchor is disclosed. Generally, the retaining wall block comprises a front surface, a rear surface, side surfaces, a top surface, and a bottom surface. More particularly, each side surface comprises a first section, a second section, a third section, and a fourth section, with the second section forming a shoulder against which a projection of a vertically adjacent block may abut, and with the fourth section configured to allow a plurality of blocks to be arranged in a convex configuration.

In accordance with one aspect of the present invention, the bottom surface is provided with front and rear projections. The front projection includes a contact edge that is configured and arranged to position the block relative to a lower course of blocks when it is placed thereon. The rear projection has dual functions, one of which is to position the block when it is placed on a lower course of blocks that are arranged in a convex course, the other of which is to facilitate stacking on a pallet for shipping.

The above block may be provided with a core that extends through the block between the top and bottom surfaces. The core reduces the amount of material needed to form the block and greatly reduces the weight thereof, resulting in a block that is easier to manufacture and manipulate.

The above block may be provided with a plurality of cores that extend through the block between the top and bottom surfaces. The core holes are separated from each other by a web that serves to strengthen the block. Again, the cores reduce the amount of material needed to form the block and reduce the weight thereof.

Alternatively, the above block may be formed without any cores between the top and bottom surfaces. This block has greater strength and weight than the previously discussed cored blocks and is particularly suited for use in lower courses and where pressure exerted by backfill is greater than what would normally be expected.

Generally, the aforementioned blocks have substantially the same height, front surface width, and depth, preferably ranging around 4 to 9 inches (10 to 23 cm), 20 to 24 inches (50 to 60 cm), and 8 to 12 inches (20 to 30 cm), respectively, and more preferably around 8 inches (20 cm), 24 inches (60 cm), and 9 inches (23 cm), respectively. The size and location of the shoulder formed by the second sections can vary, and this can change the distance between the third sections of the sides, and the lengths of the third sections from about 1 to 3 inches (2.54 to 8 cm).

In accordance with a further aspect of the invention, the bottom surface of a block is provided with a single projection that is configured and arranged to abut the shoulders of vertically adjacent blocks when a plurality of blocks are arranged to form a multi-course wall structure.

As will be understood, the above retaining wall blocks may be used with earth anchor grids such as geo-grid or steel ladders. The aforementioned embodiments may also be arranged in a plurality of configurations, such as linear and serpentine walls, or enclosures.

In another embodiment, the projection(s) on the bottom surface of the blocks may be omitted and the blocks combined with one or more intermediate members to form an engagement system that constrainingly positions vertically adjacent blocks in a wall surface.

The intermediate members may take several different forms; for example, as a pin that is received in apertures at the top and bottom surfaces of vertically adjacent blocks, as a clip that attaches to the block such that a portion thereof extends downwardly therefrom relative to the bottom surface, or as a clip that attaches to the block such that a portion thereof extends upwardly therefrom relative to the top surface.

The above projectionless blocks may be provided with one or a plurality of cores that extend through the block between the top and bottom surfaces, with the plurality of cores separated from each other by a web that serves to strengthen the block. As will be appreciated, the plurality of cores need not extend completely through the blocks. For example, the cores may form upwardly extending recesses that terminate short of the top surface.

It will be appreciated that the projectionless blocks used in conjunction with the engagement system may also be used in conjunction with earth anchors such as metal grids or lattices, and plastic grids or lattices such as geo-grid. And, while it is possible to merely position a portion of an earth anchor between adjacent courses of blocks and rely on the weight of the blocks and frictional forces to maintain the positioning of the blocks relative to the earth anchor, it is preferred to operatively connect the blocks to an earth anchor using one or more of the intermediate members.

It will be appreciated that the front surfaces of the aforementioned blocks may be provided with decorative and/or aesthetic finishes. For example, the front surfaces may be planar, angular, prismatic or curvilinear, and have a wide variety of finishes. In addition, the front surface of a single block may be provided with alpha-numeric characters, or with simulative decorative characters or objects in bas or alto relief.

Additional advantages and features of the invention will appear more fully from the following description, made in conjunction with the accompanying drawings wherein the reference characters refer to the same or similar parts throughout the several views.

BRIEF DESCRIPTION OF THE DRAWINGS

FIG. 13 is a perspective view of an extended width retaining wall block according to an embodiment of the present invention.

FIG. 14 is a side view of an extended width retaining wall block according to an embodiment of the present invention.

DETAILED DESCRIPTION OF THE DRAWINGS

Figure 1:
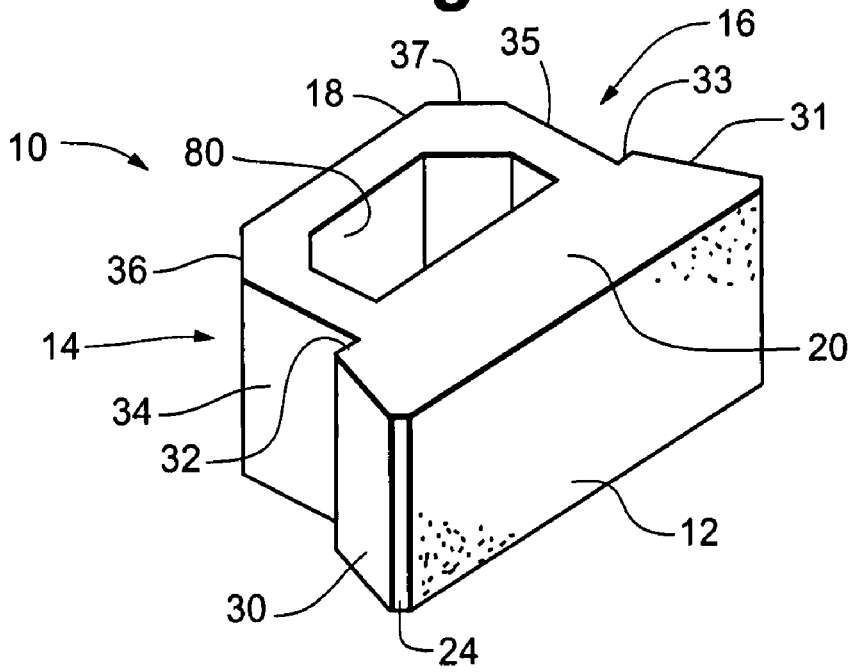
FIG. 1 is a perspective view of an extended width retaining wall block according to an embodiment of the present invention.
Figure 2:
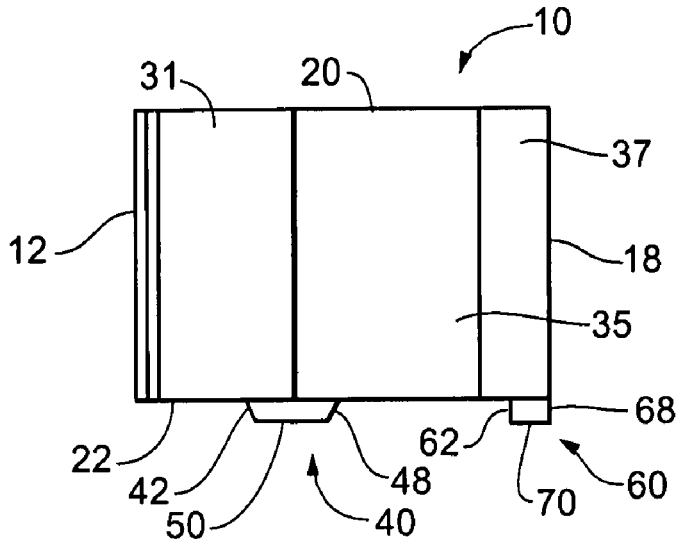
FIG. 2 is a side view of an extended width retaining wall block according to an embodiment of the present invention.
Figure 3:
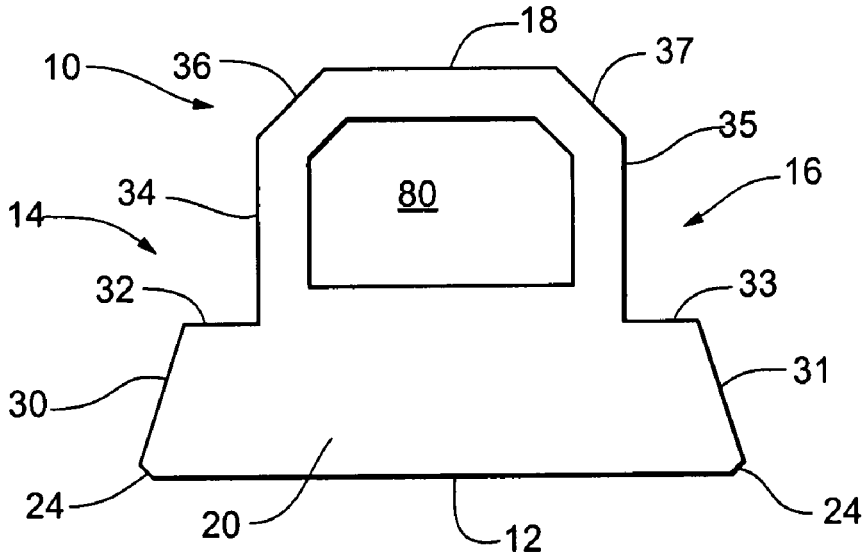
FIG. 3 is a top view of an extended width retaining wall block according to an embodiment of the present invention.
Figure 4:
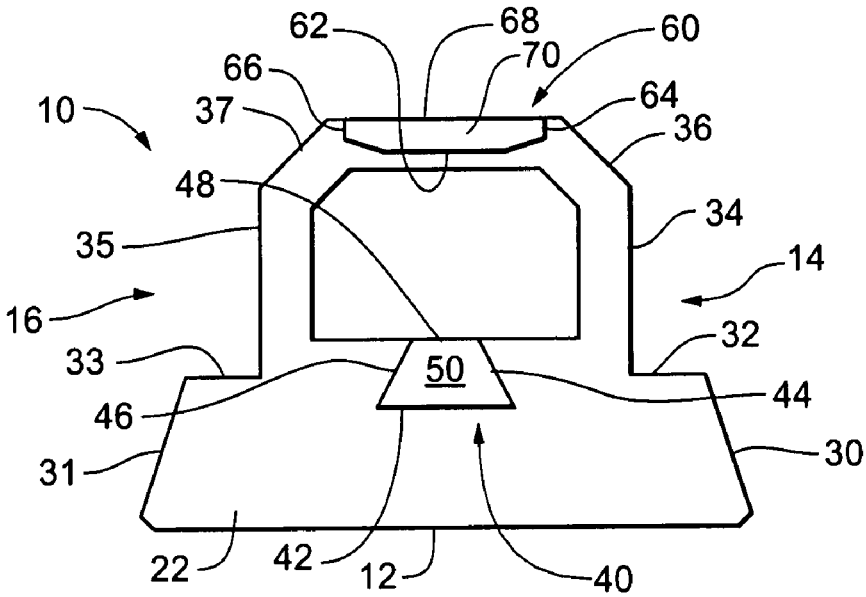
FIG. 4 is a bottom view of an extended width retaining wall block according to an embodiment of the present invention.

An embodiment of a block 10 of the present invention is shown in FIGS. 1-4. The block 10 comprises a front surface 12 and opposing rear surface 18, a top surface 20 and opposing bottom surface 22 and first 14 and second 16 opposing side surfaces 14 and 16. Although front surface 12, as depicted, features a straight face with beveled edges 24, it is understood that other surface configurations and finishes may be used.

Generally, each side surface 14 and 16 comprises a plurality of sections that are angled with respect to each other. Side surface 14 comprises a first section 30, a second section 32, a third section 34 and a fourth section 36. Similarly, side surface 16 comprises a first section 31, a second section 33, a third section 35, and a fourth section 37. Since side surfaces 14 and 16 are mirror images of each other, only side surface 14 will be discussed in detail. First section 30 extends generally linearly from front surface 12 at a generally right angle towards the rear of the block and terminates at the intersection with second section 32. Second section 32 extends generally linearly towards the center of the block at a generally right angle and terminates at the intersection with third section 34. Third section 34 extends generally linearly towards the rear of the block at a generally right angle and terminates at the intersection with fourth section 36. Fourth section 36 extends generally linearly towards the rear of the block at an angle and terminates at the intersection with rear surface 18.

First section 30, 31 of each side surface 14, 16 is configured so that when a plurality of blocks are arranged in a convex course so that first sections of adjacent blocks are in confronting relation, the size of the vertical joint formed thereby is minimized. Second section 32, 33 of each side surface 14, 16 forms a generally laterally extending shoulder that is configured to abuttingly receive a projection of a vertically adjacent block. Second sections 32, 33 are positioned outwardly beyond the lateral extent of rear surface 18. Fourth sections 36, 37 are tapered so that when a plurality of blocks are arranged in a convex course the fourth sections of adjacent blocks permit the first sections of adjacent blocks to be positioned adjacent to each other in a close fitting relation.

Bottom surface 22 includes a front projection 40 and a rear projection 60. Front projection 40 comprises a contact edge 42, side edges 44 and 46, a back edge 48 and a bottom surface 50. When a block is positioned upon a lower course of blocks and slid forward, contact edge 42 abuts against at least one shoulder of a block below. This positions the block relative to the course of blocks below and prevents forward movement that can be caused by pressure exerted from backfill material. Side edges 44 and 46 are configured so that they do not interfere with the third sections of the blocks below when a plurality of blocks are arranged in convex courses.

Rear projection 60 on bottom surface 22 has a contact edge 62, side edges 64, 66, a back edge 68 and a bottom surface 70. When a plurality of blocks are arranged in convex courses, the contact edge 62 serves to further position the block relative to the course of blocks below and prevents forward movement that can be caused by pressure exerted from backfill material by coming into an abutting relation with the rear surface of a block below. As with front projection 40, the contact edge 62 of rear projection 60 is configured and arranged so that when a block is positioned upon a convexly shaped lower course of blocks and slid forward, contact edge 62 abuts against at least one rear surface of a block below. Another function of rear projection 60 is to facilitate stacking onto a pallet for shipping.

Block 10 further includes a core 80 that extends through the block from top surface 20 to bottom surface 22. Core 80 serves several functions. It reduces the amount of material needed to form the block and it reduces overall weight of the block 10, which makes it easier to lift and manipulate.

Figure 5:
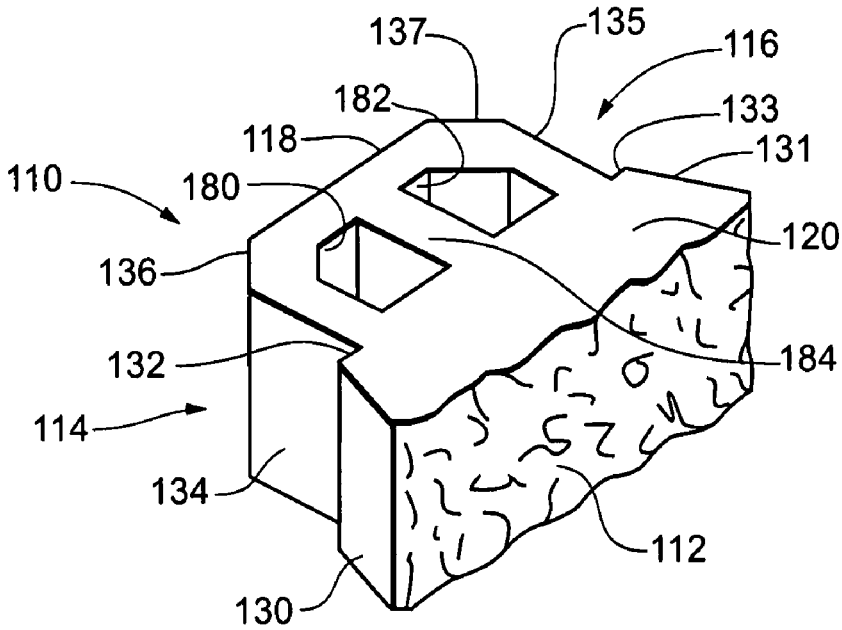
FIG. 5 is a perspective view of an extended width retaining wall block according to an embodiment of the present invention.
Figure 6:
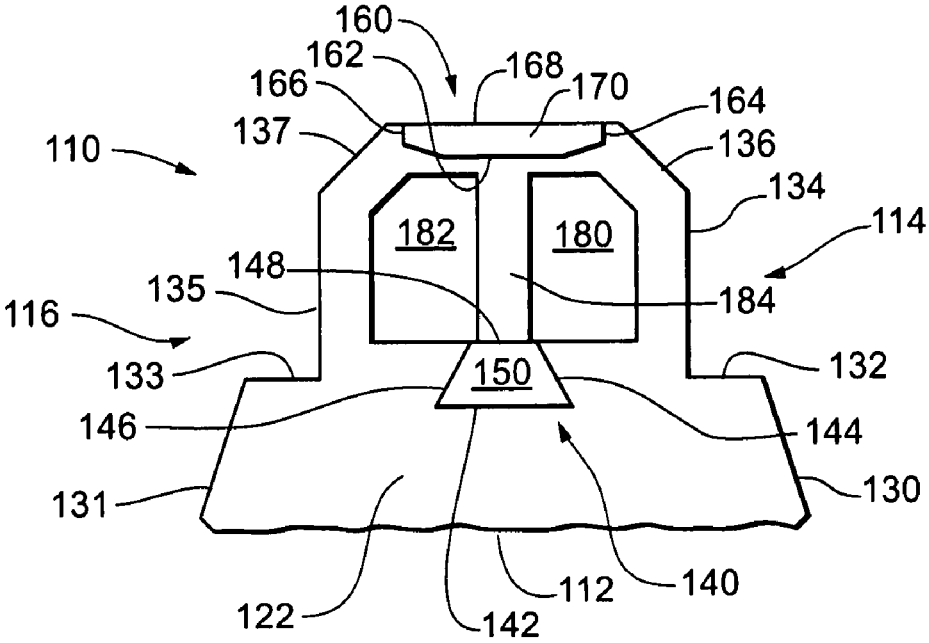
FIG. 6 is a bottom view of an extended width retaining wall block according to an embodiment of the present invention.

Another embodiment of a block 110 of the present invention is shown in FIGS. 5-6. As with the previously described embodiment, this block 110 comprises a front surface 112 and opposing rear surface 118, a top surface 120 and opposing bottom surface 122, and first 114 and second 116 opposing side surfaces 114 and 116. Although front surface 112, as depicted, features a weathered or roughened face, it is understood that other surface configurations and finishes may be used.

Similarly, each side surface 114 and 116 comprises a plurality of sections that are angled with respect to each other. Side surface 114 comprises a first section 130, a second section 132, a third section 134 and a fourth section 136. Side surface 116 comprises a first section 131, a second section 133, a third section 135, and a fourth section 137. Since side surfaces 114 and 116 are mirror images of each other, only side surface 114 will be discussed in detail. First section 130 extends generally linearly from front surface 112 at a generally right angle towards the rear of the block and terminates at the intersection with second section 132. Second section 132 extends generally linearly towards the center of the block at a generally right angle and terminates at the intersection with third section 134. Third section 134 extends generally linearly towards the rear of the block at a generally right angle and terminates at the intersection with fourth section 136. Fourth section 136 extends generally linearly towards the rear of the block at an angle and terminates at the intersection with rear surface 118.

As with the previously described block 10, the first section 130, 131 of each side surface 114, 116 is configured so that when a plurality of blocks are arranged in a convex course so that first sections of adjacent blocks are in confronting relation, the size of the vertical joint formed is minimized. Similarly, second section 132, 133 of each side surface 114, 116 forms a shoulder that is configured to abuttingly receive a projection of a vertically adjacent block. In addition, fourth section 136, 137 of each side surface 114, 116 is configured so that when a plurality of blocks are arranged in convex courses the fourth sections 136, 137 of adjacent blocks permit the first sections 130, 131 of adjacent blocks to be positioned adjacent to each other in a close fitting relation.

Bottom surface 122 includes a front projection 140 and a rear projection 160. Front projection 140 comprises a contact edge 142, side edges 144 and 146, a back edge 148 and a bottom surface 150. When a block is positioned upon a lower course of blocks and slid forward, contact edge 142 abuts against at least one shoulder of a block below. This positions the block relative to the course of blocks below and prevents forward movement that can be caused by pressure exerted from backfill material. Side edges 144 and 146 are configured so that they do not interfere with the third sections of the blocks below when a plurality of blocks are arranged in convex courses.

Rear projection 160 on bottom surface 122 has a contact edge 162, side edges 164, 166, a back edge 168 and a bottom surface 170. When a plurality of blocks are arranged in convex courses, the contact edge 162 serves to further position the block relative to the course of blocks below and prevents forward movement that can be caused by pressure exerted from backfill material by coming into an abutting relation with the rear surface of a block below. As with front projection 140, the contact edge 162 of rear projection 160 is configured and arranged so that when a block is positioned upon a convexly shaped lower course of blocks and slid forward, contact edge 162 abuts against at least one rear surface of a block below. Another function of rear projection 160 is to facilitate stacking onto a pallet for shipping.

The block 110 differs from the previously described block 10 in that instead of having a single core, this embodiment includes two cores 180, 182, that extend through the block from top surface 120 to bottom surface 122. Cores 180, 182 are separated from each other by a web 184, which serves to strengthen the block. Cores 180 and 182 serve several functions. They reduce the amount of material needed to form the block and they reduce overall weight of the block 110, which makes it easier to lift and manipulate.

Figure 7:
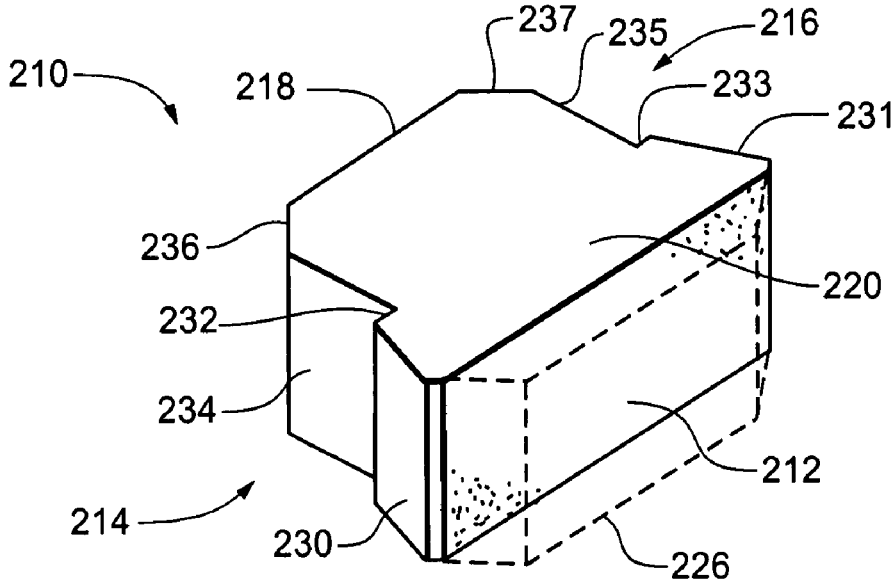
FIG. 7 is a perspective view of an extended width retaining wall block according to an embodiment of the present invention.
Figure 8:
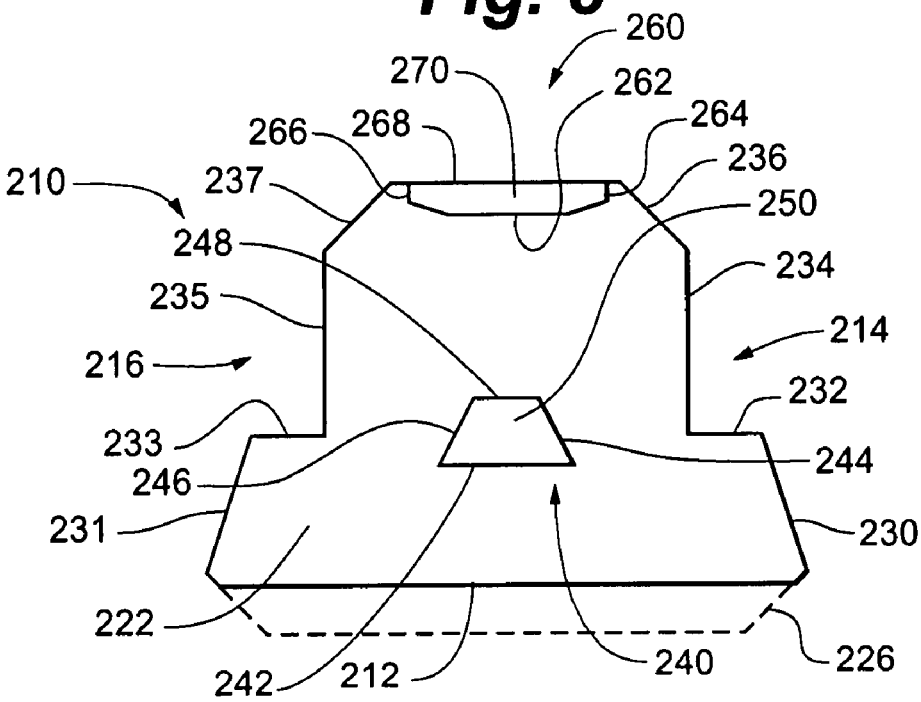
FIG. 8 is a bottom view of an extended width retaining wall block according to an embodiment of the present invention.

Another embodiment of the present invention is shown in FIGS. 7-8. As with the previously described embodiments, this block 210 comprises a front surface 212 and opposing rear surface 218, a top surface 220 and opposing bottom surface 222, and first 214 and second 216 opposing side surfaces. Although front surface 212, as depicted, features a generally flat face, it is understood that other surface configurations and finishes may be used. For example, the front surface may be provided with a plurality of facets 226 (shown in dashed lines).

Similarly, each side surface 214 and 216 comprises a plurality of sections that are angled with respect to each other. Side surface 214 comprises a first section 230, a second section 232, a third section 234 and a fourth section 236. Side surface 216 comprises a first section 231, a second section 233, a third section 235, and a fourth section 237. Since side surfaces 214 and 216 are mirror images of each other, only side surface 214 will be discussed in detail. First section 230 extends generally linearly from front surface 212 at a generally right angle towards the rear of the block and terminates at the intersection with second section 232. Second section 232 extends generally linearly towards the center of the block at a generally right angle and terminates at the intersection with third section 234. Third section 234 extends generally linearly towards the rear of the block at a generally right angle and terminates at the intersection with fourth section 236. Fourth section 236 extends generally linearly towards the rear of the block at an angle and terminates at the intersection with rear surface 218.

As with the previously described blocks 10 and 110, the first section 230, 231 of each side surface 214, 216 is configured so that when a plurality of blocks are arranged in a convex course so that first sections of adjacent blocks are in confronting relation, the size of the vertical joint formed is minimized. Similarly, second section 232, 233 of each side surface 214, 216 forms a shoulder that is configured to abuttingly receive a projection of a vertically adjacent block. In addition, fourth section 236, 237 of each side surface 214, 216 is configured so that when a plurality of blocks are arranged in convex courses the fourth sections 236, 237 of adjacent blocks permit the first sections 230, 231 of adjacent blocks to be positioned adjacent to each other in a close fitting relation.

Bottom surface 222 includes a front projection 240 and a rear projection 260. Front projection 240 comprises a contact edge 242, side edges 244 and 246, a back edge 248 and a bottom surface 250. When a block is positioned upon a lower course of blocks and slid forward, contact edge 242 abuts against at least one shoulder of a block below. This positions the block relative to the course of blocks below and prevents forward movement that can be caused by pressure exerted from backfill material. Side edges 244 and 246 are configured so that they do not interfere with the third sections of the blocks below when a plurality of blocks are arranged in convex courses.

Rear projection 260 on bottom surface 222 has a contact edge 262, side edges 264, 266, a back edge 268 and a bottom surface 270. When a plurality of blocks are arranged in convex courses, the contact edge 262 serves to further position the block relative to the course of blocks below and prevents forward movement that can be caused by pressure exerted from backfill material by coming into an abutting relation with the rear surface of a block below. As with front projection 240, the contact edge 262 of rear projection 260 is configured and arranged so that when a block is positioned upon a convexly shaped lower course of blocks and slid forward, contact edge 262 abuts against at least one rear surface of a block below. Another function of rear projection 260 is to facilitate stacking onto a pallet for shipping.

The block 210 differs from the previously described embodiments in that it has a substantially solid and continuous top surface 220. As will be appreciated, this embodiment is comparatively robust and may be used in applications where force exerted by backfill is expected to be relatively high.

Figure 9:
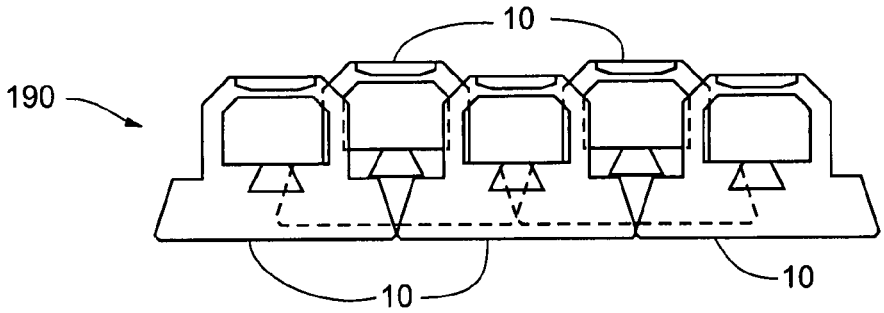
FIG. 9 is a bottom view of a wall formed by a plurality of extended width retaining wall blocks according to an embodiment of the present invention.
Figure 10:
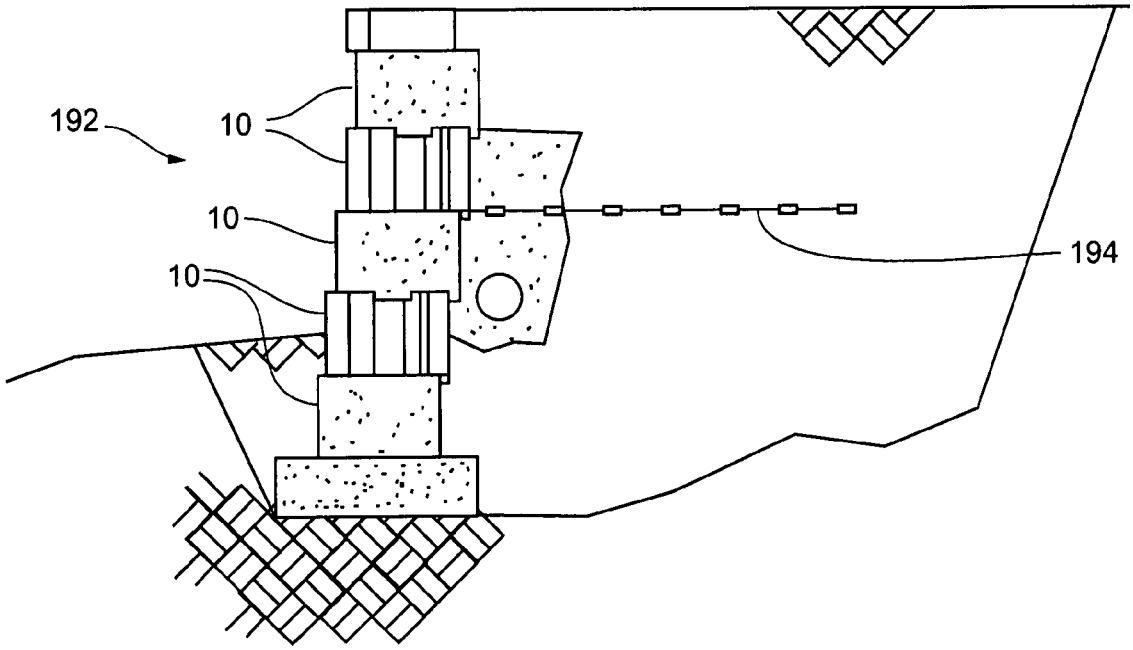
FIG. 10 is a side view of a wall formed by a plurality of extended width retaining wall blocks according to an embodiment of the present invention.
Figure 11:
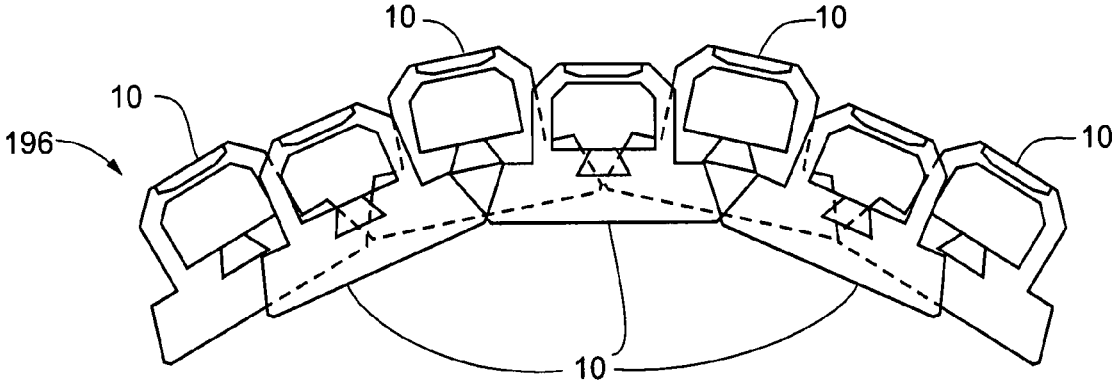
FIG. 11 is a bottom view of a wall formed by a plurality of extended width retaining wall blocks according to an embodiment of the present invention.
Figure 12:
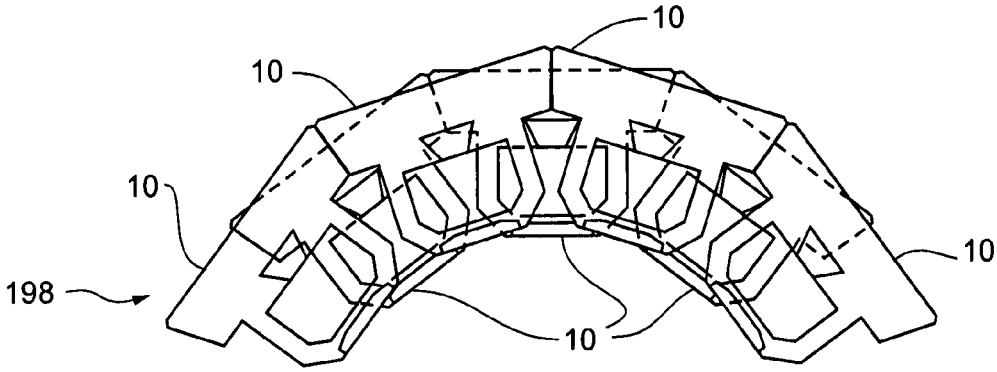
FIG. 12 is a bottom view of a wall formed by a plurality of extended width retaining wall blocks according to an embodiment of the present invention.
Figure 15:
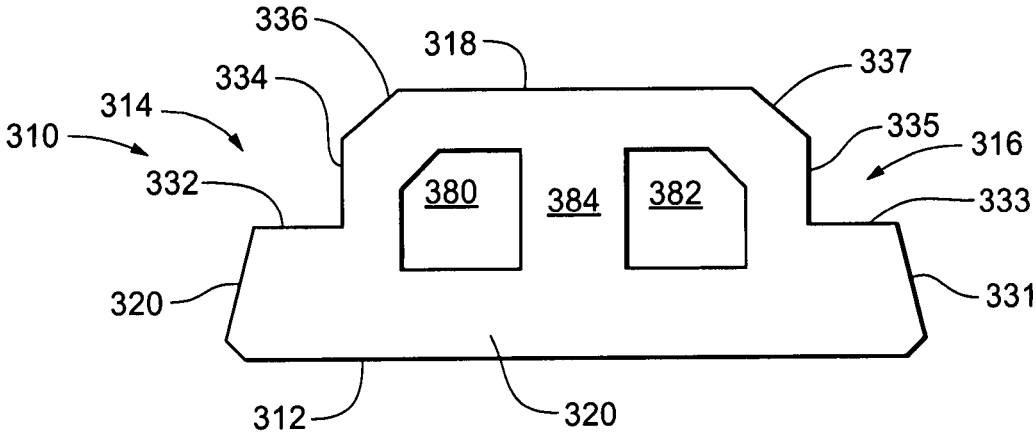
FIG. 15 is a top view of an extended width retaining wall block according to an embodiment of the present invention.
Figure 16:
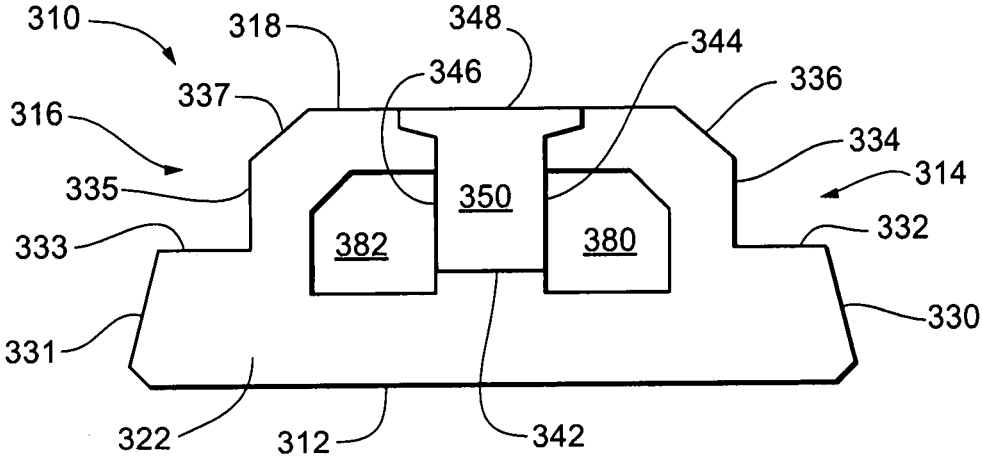
FIG. 16 is a bottom view of an extended width retaining wall block according to an embodiment of the present invention.

Examples of embodiments of wall structures that may be constructed using the above described blocks 10, 110 and 210 are depicted in FIGS. 9-12. The wall structure 190 of FIG. 9 depicts a bottom view of two courses of blocks that are linearly arranged. FIG. 10 shows a plurality of courses in side elevation with an earth anchor or grid 194 used therewith. It will be understood that the particular type of earth anchor used with the above described blocks is up to the discretion of a user. For example, a user may use a metallic lattice earth anchor, or a flexible plastic earth anchor. The wall structures 196, 198 of FIGS. 11 and 12, respectively depict arrangements that are generally concave and generally convex. It will be understood that the foregoing wall structures may be constructed with any of the above described blocks 10, 110, 210, or with combinations thereof.

Another embodiment of the present invention is shown in FIGS. 13-16. With this embodiment, the shape of the block 310 is wider and shallower compared to the previously described embodiments. This enables the block to be formed with existing molding machinery in a more efficient manner. And, because the block has a larger front surface 312 than conventional blocks, it takes fewer blocks to form a wall structure. This has the effect of speeding up construction. Preferably, the block 310 has a width in the range of about 18 to 38 inches (46 to 96 cm), a height in the range of about 4 to 12 inches (10 to 30 cm), and a depth in the range of about 4 to 24 inches (10 to 60 cm). More preferably, block 310 has a width in the range of about 20 to 24 inches (50 to 60 cm), a height in the range of about 4 to 9 inches (10 to 23 cm), and a depth in the range of about 9 to 12 inches (23 to 30 cm). The block may therefore have a volume in the range of about 288 to 1,800 cubic inches (4,680 to 28,800 cc) or a weight in the range of about 18 to 150 lbs (8 to 68 kg). Preferably, the width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches (60 cm) and a depth of around 18 inches (46 cm).

As with the previously described embodiments, this block 310 comprises a front surface 312 and opposing rear surface 318, a top surface 320 and opposing bottom surface 322 and first 314 and second 316 opposing side surfaces. Although front surface 312, as depicted, features a generally flat face, it is understood that other surface configurations and finishes may be used.

Each side surface 314 and 316 comprises a plurality of sections that are angled with respect to each other. Side surface 314 comprises a first section 330, a second section 332, a third section 334 and a fourth section 336. Side surface 316 comprises a first section 331, a second section 333, a third section 335, and a fourth section 337. Since side surfaces 314 and 316 are mirror images of each other, only side surface 314 will be discussed in detail. First section 330 extends generally linearly from front surface 312 at a generally right angle towards the rear of the block and terminates at the intersection with second section 332. Second section 332 extends generally linearly towards the center of the block at a generally right angle and terminates at the intersection with third section 334. Third section 334 extends generally linearly towards the rear of the block at a generally right angle and terminates at the intersection with fourth section 336. Fourth section 336 extends generally linearly towards the rear of the block at an angle and terminates at the intersection with rear surface 318.

As with the previously described blocks, the first section 330, 331 of each side surface 314, 316 is configured so that when a plurality of blocks are arranged in a convex course so that first sections of adjacent blocks are in confronting relation, the size of the vertical joint formed is minimized. Similarly, second section 332, 333 of each side surface 314, 316 forms a shoulder that is configured to abuttingly receive a projection of a vertically adjacent block. In addition, fourth section 336, 337 of each side surface 314, 316 is configured so that when a plurality of blocks are arranged in convex courses the fourth sections 336, 337 of adjacent blocks permit the first sections 330, 331 of adjacent blocks to be positioned adjacent to each other in a close fitting relation.

Bottom surface 322 includes a projection 340 extending downwardly from bottom surface 322 that comprises a contact edge 342, side edges 344 and 346, a back edge 348 and a bottom surface 350. When a block is positioned upon a lower course of blocks and slid forward, contact edge 342 abuts against at least one shoulder of a block below. This positions the block relative to the next lower course of blocks below and prevents forward movement that can be caused by pressure exerted from backfill material. Side edges 344 and 346 are configured so that they do not interfere with the third sections of blocks in a course below when a plurality of blocks are arranged in convex courses.

The block 310 is similar to block 110 in that it includes two cores 380 and 382, which extend through the block from top surface 320 to bottom surface 322. Cores 380, 382 are separated from each other by a web 384, which serves to strengthen the block. Cores 380 and 382 serve several functions. They reduce the amount of material needed to form the block and the overall weight of the block 310, which increases the facing area-to-block weight ratio, and makes it easier to lift and manipulate. Because the weight of the block is comparable to the weight of prior art blocks while the front surface 312 is larger it will be appreciated that it takes fewer blocks and less time to construct a wall with the present invention that it would take to build to build similarly sized wall using prior art blocks.

Figure 17:
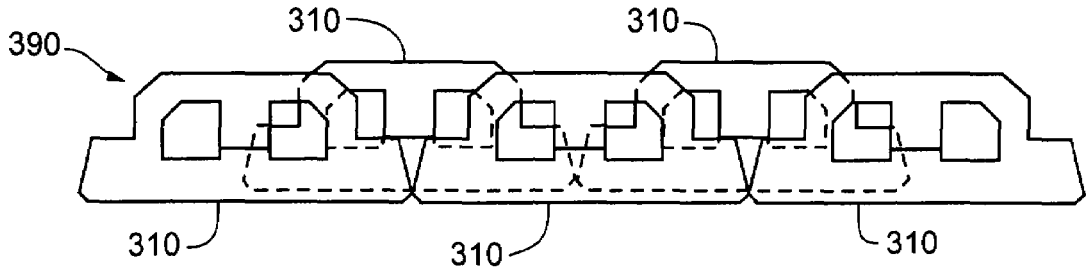
FIG. 17 is a bottom view of a wall formed by a plurality of extended width retaining wall blocks according to an embodiment of the present invention.
Figure 18:
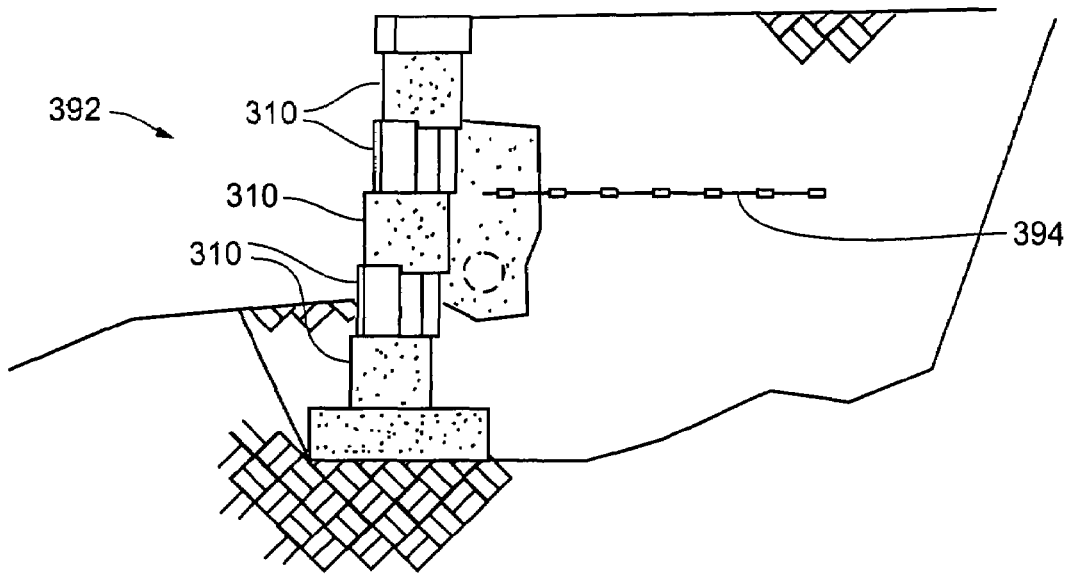
FIG. 18 is a side view of a wall formed by a plurality of extended width retaining wall blocks according to an embodiment of the present invention.
Figure 19:
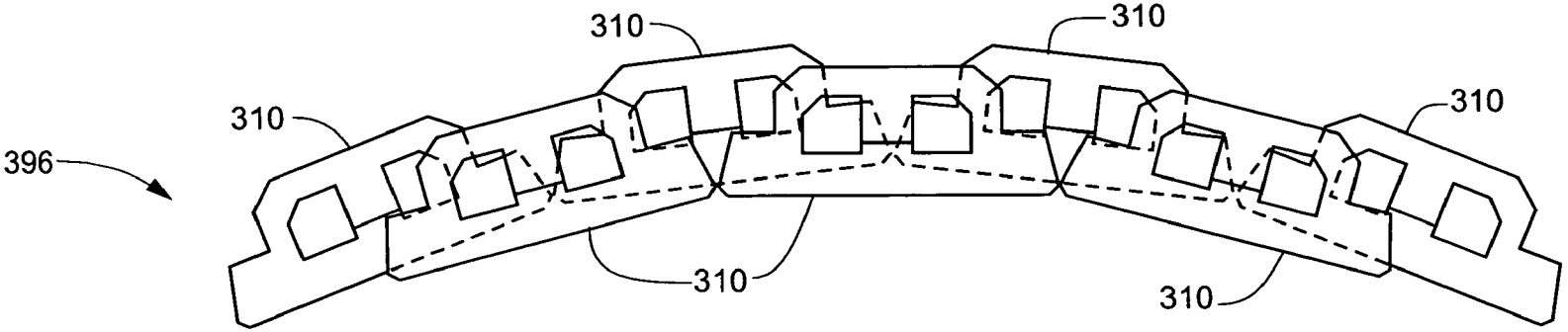
FIG. 19 is a bottom view of a wall formed by a plurality of extended width retaining wall blocks according to an embodiment of the present invention.
Figure 20:
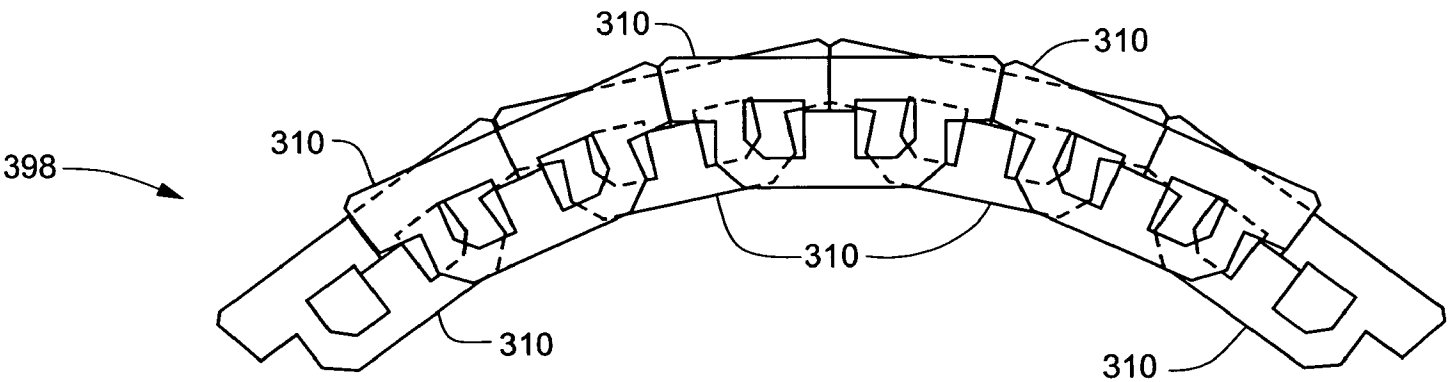
FIG. 20 is a bottom view of a wall formed by a plurality of extended width retaining wall blocks according to an embodiment of the present invention.

Examples of embodiments of wall structures that may be constructed using the above described blocks 310 are depicted in FIGS. 17-20. FIG. 17 depicts a bottom view of a wall structure 390 having two linearly arranged courses of blocks. The wall structure 392 of FIG. 18 depicts a plurality of courses in side elevation with an earth anchor or grid 394 used therewith. It will be understood that the particular type of earth anchor used with the above described blocks is up to the discretion of a user. For example, a user may use a metallic lattice earth anchor, or a flexible plastic earth anchor. The wall structures 396 and 398 of FIGS. 19 and 20, respectively, depict arrangements that are generally concave and generally convex. It will be understood that the foregoing wall structures may be constructed with any of the above described blocks, or with combinations thereof.

Another embodiment of a block 410 of the present invention is shown in FIGS. 21-26. This block 410 is similar to the block of FIGS. 13-16 and preferably has a width in the range of about 18 to 38 inches (46 to 96 cm), a height in the range of about 4 to 12 inches (10 to 30 cm), and a depth in the range of about 4 to 24 inches (10 to 60 cm). More preferably, the block has a width in the range of about 20 to 24 inches (50 to 60 cm), a height in the range of about 4 to 9 inches (10 to 23 cm), and a depth in the range of about 9 to 12 inches (23 to 30 cm). The block may accordingly have a volume in the range of about 288 to 1,800 cubic inches (4,680 to 28,800 cc) or a weight in the range of about 18 to 150 pounds (8 to 68 kg). Preferably, through, the width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches (60 cm) and a depth of around 18 inches (46 cm).

As with the previously described embodiments, block 410 comprises a front surface 412 and opposing rear surface 418, a top surface 420 and opposing bottom surface 422 and first 414 and second 416 opposing side surfaces 414 and 416. Although front surface 412, as depicted, is substantially planar, it is understood that other surface configurations and finishes may be used.

Each side surface 414 and 416 comprises a plurality of sections that are angled with respect to each other. Side surface 414 comprises a first section 430, a second section 432, a third section 434 and a fourth section 436. Side surface 416 comprises a first section 431, a second section 433, a third section 435, and a fourth section 437. Since side surfaces 414 and 416 are mirror images of each other, only side surface 414 will be discussed in detail. First section 430 extends generally linearly from front surface 412 at a generally right angle towards the rear of the block and terminates at the intersection with second section 432. Second section 432 extends generally linearly towards the center of the block at a generally right angle and terminates at the intersection with third section 434. Third section 434 extends generally linearly towards the rear of the block at a generally right angle and terminates at the intersection with fourth section 436. Fourth section 436 extends generally linearly towards the rear of the block at an angle and terminates at the intersection with rear surface 418.

Side surfaces 414, 416 are configured so that when a plurality of blocks are arranged in a convex course so that first sections 430, 431 of adjacent blocks are in confronting relation, the size of the vertical joint formed thereby is minimized. Thus, rear surface 418 is about one-half to two-thirds the width of the front surface 412. As will be appreciated, this configuration reduces the amount of material needed to manufacture the block, which reduces the overall weight of the block and makes it easier to lift and manipulate.

Top surface 420 includes a plurality of apertures 454, 455, which extend towards the bottom of the block and which are sized to receive pins 460 and 461. Bottom surface 422 includes a downwardly depending projection 440 comprising a contact edge 442, side edges 444 and 446, a back edge 448 and a bottom surface 450. When a block is positioned upon a lower course of blocks and slid forward, contact edge 442 abuts against at least one shoulder of a block below. This positions the block relative to the next lower course of blocks below and prevents forward movement that can be caused by pressure exerted from backfill material. Side edges 444 and 446 are configured so that they do not interfere with the third sections of blocks below when a plurality of blocks are arranged in convex courses.

Figure 21:
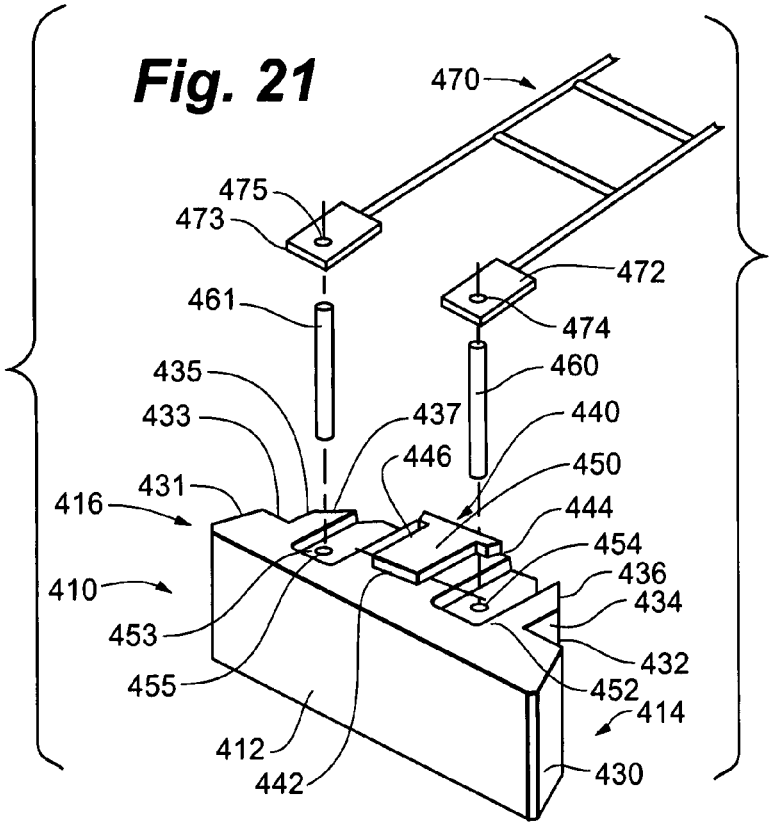
FIG. 21 is a perspective view of an extended width retaining wall block and earth anchor according to an embodiment of the present invention.
Figure 22:
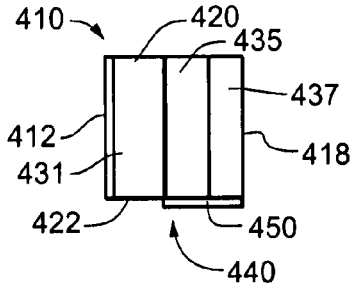
FIG. 22 is a side view of an extended width retaining wall block according to an embodiment of the present invention.
Figure 23:
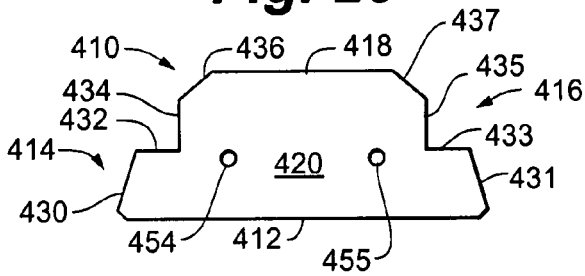
FIG. 23 is a top view of an extended width retaining wall block according to an embodiment of the present invention.
Figure 24:
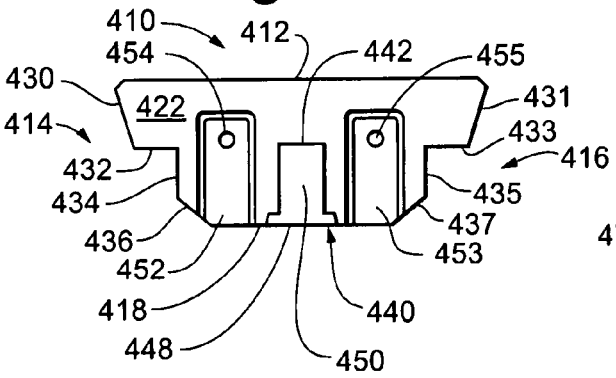
FIG. 24 is a bottom view of an extended width retaining wall block according to an embodiment of the present invention.
Figure 25:
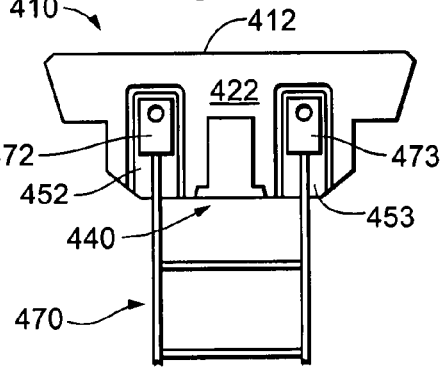
FIG. 25 is a bottom view of an extended width retaining wall block and earth anchor according to an embodiment of the present invention.

Bottom surface 422 further includes a plurality of channels 452, 453, which extend from the rear surface 418 towards the front surface 412 of the block 410. Preferably, apertures 454 and 455 are located within channels 452 and 453. As depicted in FIGS. 21 and 25, channels 452 and 453 are configured to receive attachment members 472 and 473 of an earth anchor 470. Attachment members 472 and 473 are also provided with apertures 474 and 475, which are configured to admit pins 460 and 461. As will be understood, when a plurality of blocks 410 are positioned in vertically adjacent courses to form a structure, the attachment members 472 and 473 will be constrained by the pins and blocks.

Apertures 454 and 455 enable pins 460, 461 to constrainingly position blocks in vertically adjacent courses in a wall structure. It will be further appreciated that apertures 425 and 427 may be substantially vertical or rearwardly angled to enable wall structures constructed therewith to be substantially vertical or have an upwardly receding slope, or batter. It will be appreciated that with pins that extend between two or more courses of blocks, the downwardly depending projection 440 may be omitted, if desired.

Figure 26:
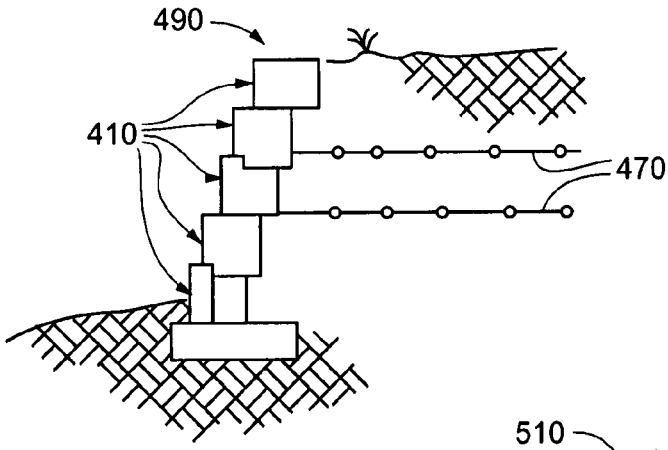
FIG. 26 is a side view of a wall formed by a plurality of extended width retaining wall blocks according to an embodiment of the present invention.

A wall structure that may be constructed using the above described blocks 410 is depicted in FIG. 26. Wall structure 490, comprising a plurality of blocks 410 in a plurality of courses, is depicted in side elevation. Wall structure 490 also shows the use of at least one earth anchor or grid 470. Note that the earth anchor 470 may be operatively connected to the wall structure 490 by pins 460 and 461 which extend between adjacent courses and engage the attachment members 472 and 473 of earth anchor 470. It will be understood that the particular type of earth anchor used with the above described blocks and pins is up to the discretion of a user. For example, a metallic lattice earth anchor or a flexible plastic mesh earth anchor.

Figure 27:
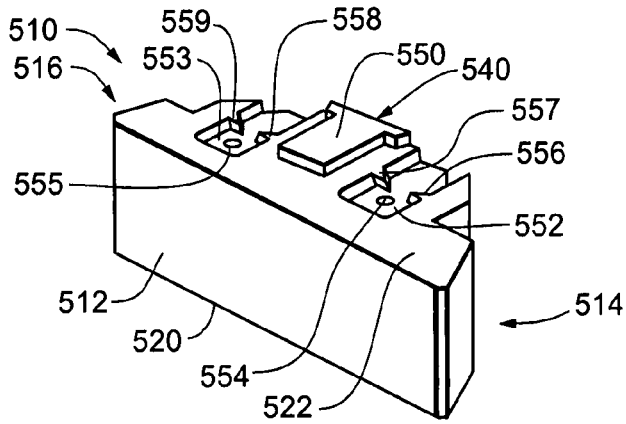
FIG. 27 is a perspective view of an extended width retaining wall block according to an embodiment of the present invention.
Figure 28:
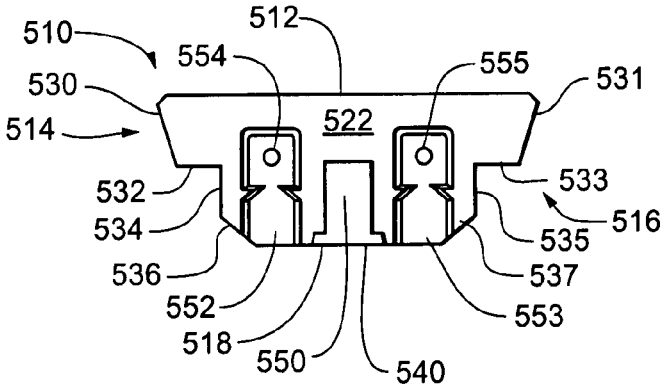
FIG. 28 is a bottom view of an extended width retaining wall block according to an embodiment of the present invention.
Figure 29:
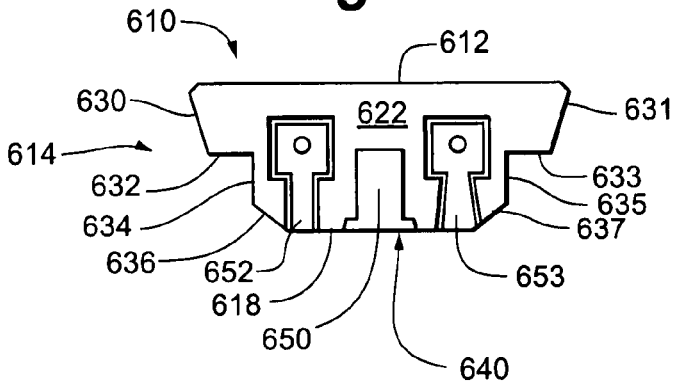
FIG. 29 is a bottom view of an extended width retaining wall block according to an embodiment of the present invention.
Figure 30:
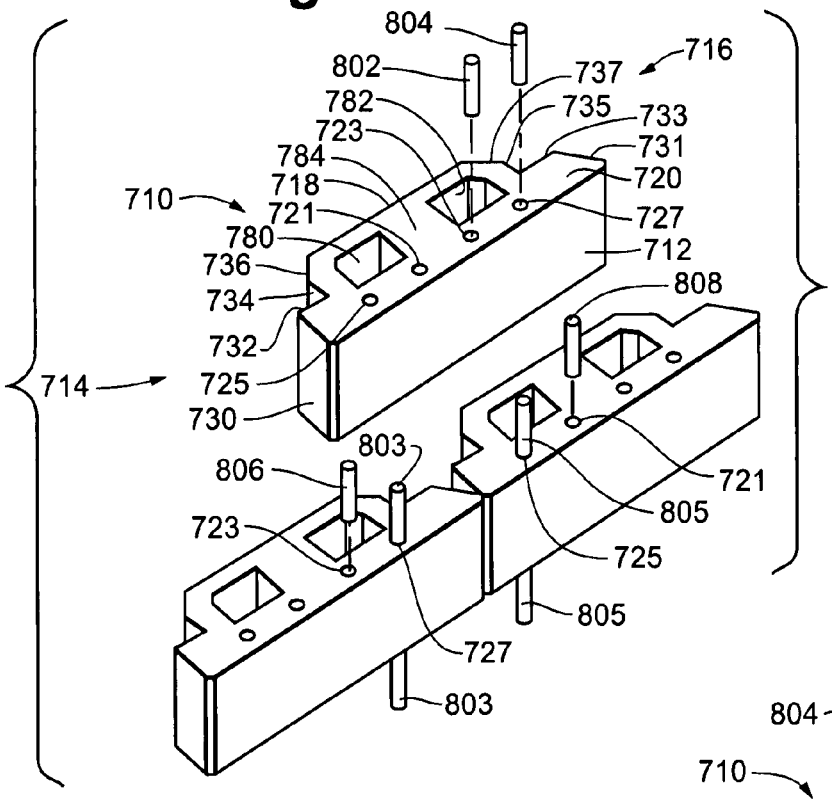
FIG. 30 is a perspective view of plurality of extended width retaining wall blocks and pins according to an embodiment of the present invention.
Figure 31:
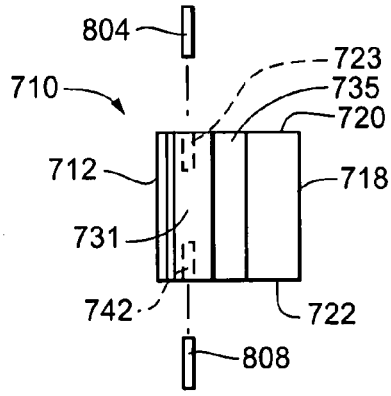
FIG. 31 is a side view of an extended width retaining wall block and pins according to an embodiment of the present invention.
Figure 32:
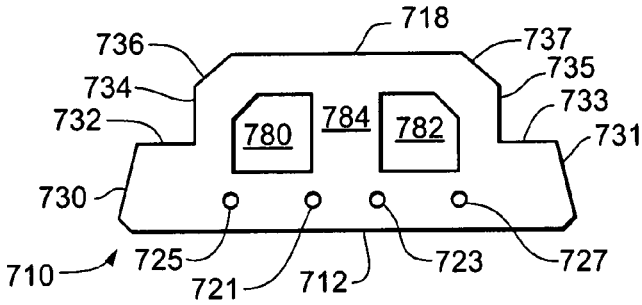
FIG. 32 is a top view of an extended width retaining wall block according to an embodiment of the present invention.
Figure 33:
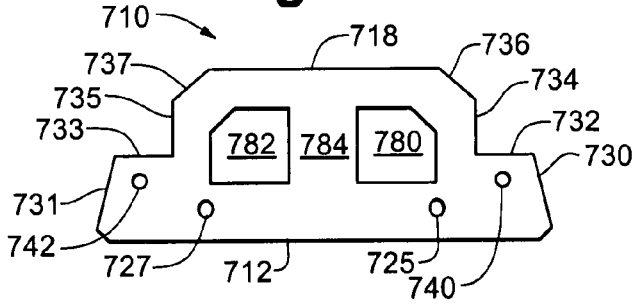
FIG. 33 is a bottom view of an extended width retaining wall block according to an embodiment of the present invention.

Alternative embodiments of block 410 are depicted in FIGS. 27-29. As with the previously described embodiments, blocks 510 and 610 comprise front surfaces 512, 612, side surfaces 514, 516, and 614, 616, rear surfaces 518, 618, top surfaces 520, 620, and bottom surfaces 522, 622.

Each side surface 514, 516, and 614, 616 comprises a plurality of sections that are angled with respect to each other. Side surfaces 514, 614 comprise first sections 530, 630, second sections 532,632, third sections 534, 634 and fourth sections 536, 636. Side surfaces 516 and 616 comprise first sections 531, 631, second sections 533, 633, third sections 535, 635, and fourth sections 537, 637. Since the sections of side surfaces 514, 516, and 614, 616 are similar to previously described side surfaces they are not discussed here in detail.

Bottom surfaces 522, 622 differ from the bottom surface 422 of block 410 in that they are provided with alternative channel configurations. In FIGS. 27-28, channels 552 and 553 are provided with opposing stops 556, 557, and 558, 559, which form constrictions. The stops prevent rearward movement of attachment members 472 and 473 of earth anchor 270. As will be appreciated, such channels permit blocks 510 and 610 to be operatively connected to earth anchors with or without the use of pins. It will also be appreciated that channels may take many other forms. For example, in FIG. 29, channel 652 has an enlarged portion and a thinned portion, while channel 653 has an enlarged portion and a flared portion.

Another embodiment of a block of the present invention is shown in FIGS. 30-34. with the exception of the omission of a downwardly depending projection, block 710 is similar to the block of FIGS. 13-16 and preferably has a width in the range of about 18 to 38 inches (46 to 96 cm), a height in the range of about 4 to 12 inches (10 to 30 cm), and a depth in the range of about 4 to 24 inches (10 to 60 cm). Block may therefore have a volume in the range of about 288 to 1,800 cubic inches (4,680 to 38,800 cc) or a weight in the range of about 18 to 150 pounds (8 to 68 kg). Preferably, the width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches (60 cm) and a depth of around 18 inches (46 cm).

As with the previously described embodiments, block 710 comprises a front surface 712, side surfaces 714 and 716, a rear surface 720 and a bottom surface 722. Although front surface 712, as depicted, is substantially planar, it is understood that other surface configurations and finishes may be used.

Each side surface 714, 716 comprises a plurality of sections that are angled with respect to each other. Side surface 714 comprises a first section 730 a second section 732, a third section 734 and a fourth section 736. Side surface 716 comprises a first section 731, a second section 733, a third section 735, and a fourth section 737. Since the sections of side surfaces 714 and 716 are similar to previously described side surfaces they are not discussed here in detail.

As with the previously described embodiments, side surfaces 714, 716 are configured so that when a plurality of blocks are arranged in a convex course so that first sections 730, 731 of adjacent blocks are in confronting relation, the size of the vertical joint formed thereby is minimized. Thus, the rear surface 718 is about one-half to two-thirds the width of the front surface 712. This configuration reduces the amount of material needed to manufacture the block, which reduces the overall weight of the block and makes it easier to lift and manipulate.

Top surface 720 includes a plurality of apertures 721, 723, which extend partially towards the bottom of the block and which are sized to receive lower portions of pins 802 and 804. Bottom surface 722 includes a plurality of corresponding apertures 740, 742, which extend partially towards the top of the block and which are sized to receive upper portions of pins 806 and 808 so that two vertically adjacent blocks may be constrainingly positioned in a wall structure.

Top surface may also include apertures 725 and 727, which may extend through the block to the bottom surface of the block so that pins 803 and 805, which have a length greater than the height of the block, may be used therewith. For example, a pin may extend above the top surface, below the bottom surface, or above and below the top and bottom surfaces. Apertures 725 and 727 enable the engagement system to constrainingly position blocks in more than two vertically adjacent courses in a wall structure. Apertures 725 and 727 may be substantially vertical or rearwardly angled to enable wall structures constructed therewith to be substantially vertical or have an upwardly receding slope, or batter.

Block 710 is similar to block 310 in that it may include two cores 780 and 782, which extend through the block from top surface 720 to bottom surface 722. Cores 780, 782 are separated from each other by a web 784, which serves to strengthen the block. Cores 780 and 782 serve several functions. They reduce the amount of material needed to form the block and they reduce overall weight of the block 710, which makes it easier to lift and manipulate. Alternatively, block 710 may be provided with recesses that extend upwardly from the bottom surface, and which stop short of the top surface (not shown).

Figure 34:
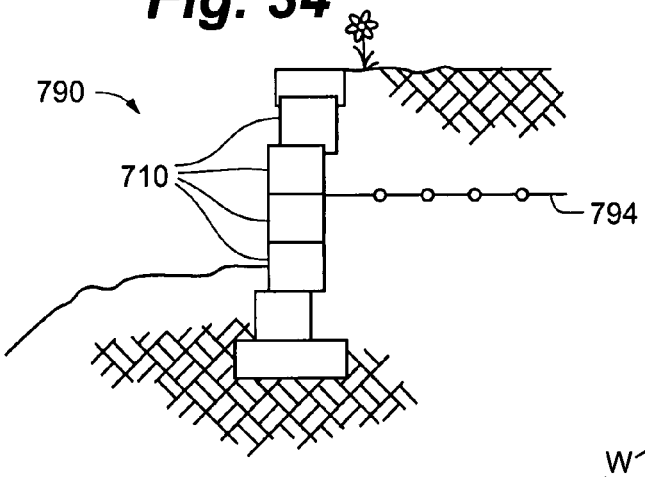
FIG. 34 is a side view of a wall formed by a plurality of extended width retaining wall blocks according to an embodiment of the present invention.

A wall structure that may be constructed using above described blocks is depicted in FIG. 34. Wall structure 790, which comprises a plurality of blocks 710 in a plurality of courses, is depicted in side elevation. Wall structure 790 may also be used with an earth anchor or grid 794. Note that earth anchor 794 may be operatively connected to the wall structure 790 by looping it over one or more of the above described pins. It will be understood that the particular type of earth anchor used with the above described blocks is up to the discretion of a user. For example, a metallic lattice earth anchor or a flexible plastic earth anchor.

Figure 35:
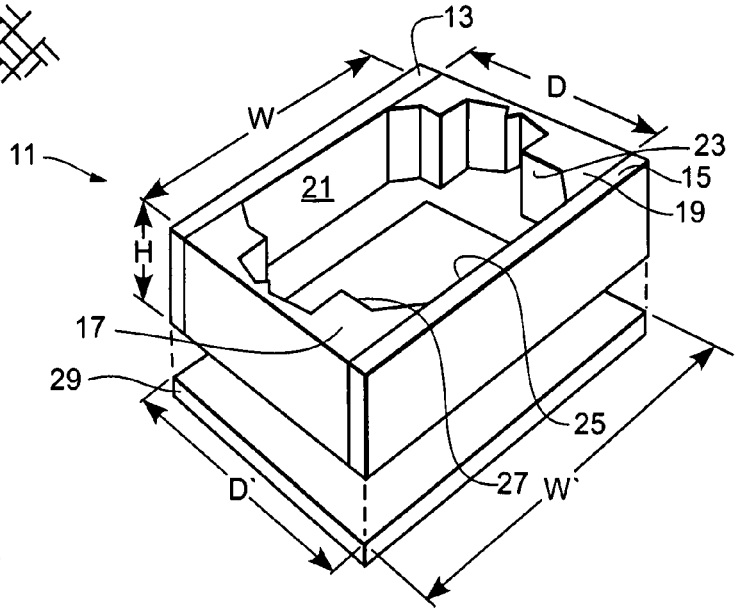
FIG. 35 is a perspective view of a mold box and pallet according to an embodiment of the present invention.
Figure 36:
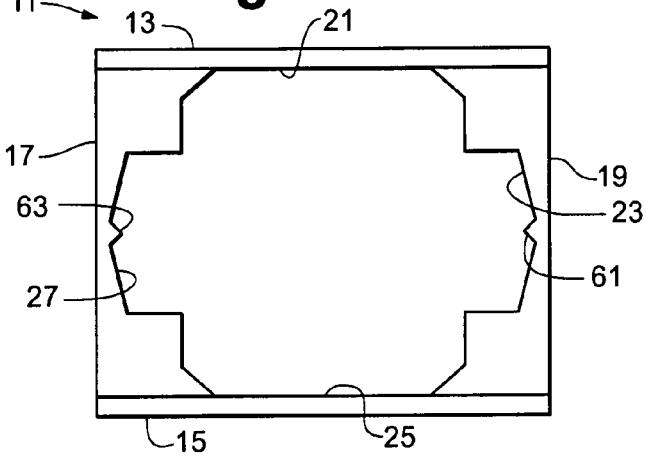
FIG. 36 is a top view of a mold box according to an embodiment of the present invention.

In accordance with another aspect of the present invention there is provided a mold box 1011 and a pallet 1029. As shown in FIGS. 35-36, mold box 1011 comprises a pair of opposing end walls 1013, 1015 and a pair of opposing side walls 1017, 1019, which are connected together in a conventional manner to define the interior of the mold box 1011. When mold box 1011 is positioned upon a pallet 1029, a cavity is defined by pallet 1029 and the interior surfaces 1021, 1023, 1025, 1027 of mold box. The cavity has a depth D defined by surface 1021 and 1025, a width W defined by surfaces 1023 and 1027, and a height H. The depth and width dimensions of the mold box 1011 are substantially the same as the depth D' and width W' of the pallet 1029. The height H is preferably around 9 inches (23 cm). The similarity in dimensions permits the mold 1011 and pallet 1029 to be used more efficiently. The mold box 1011 can be configured and arranged to be used in conjunction with a standard sized pallet having preferred nominal dimensions about 18 inches (46 cm) by 24 inches (61 cm). One of skill in the art will recognized that other standard sized pallets may be used.

Figure 37:
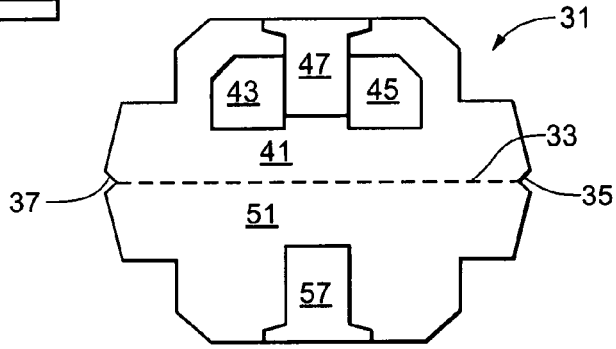
FIG. 37 is a slug formed in a mold box according to an embodiment of the present invention.
Figure 38:
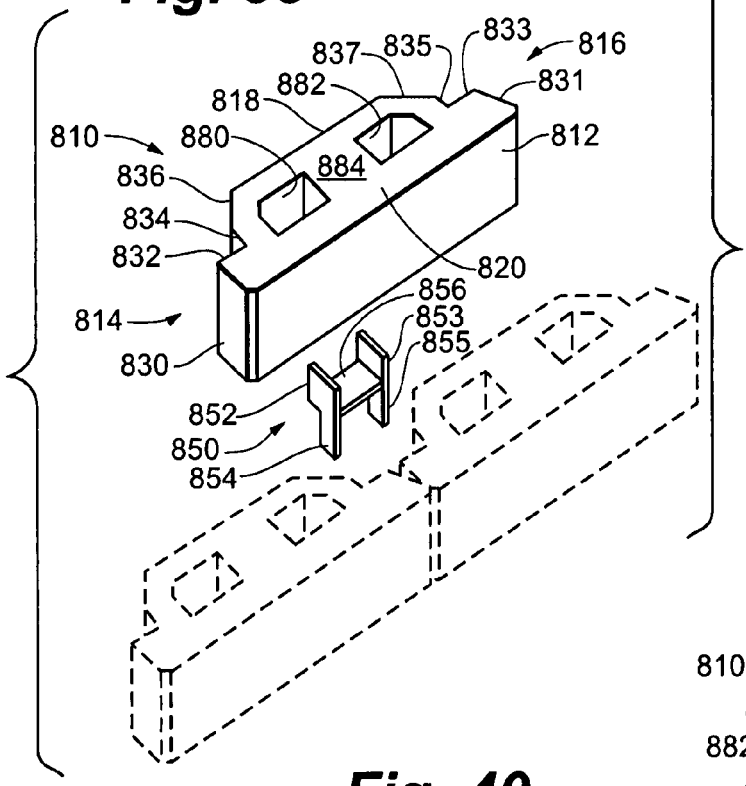
FIG. 38 is a perspective view of a plurality of extended width retaining wall blocks and a clip according to an embodiment of the present invention.
Figure 39:
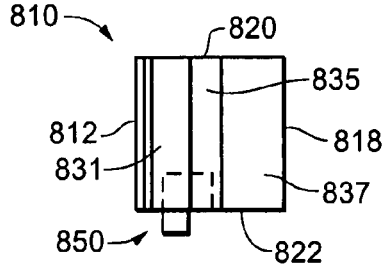
FIG. 39 is a side view of an extended width retaining wall block and a clip according to an embodiment of the present invention.
Figure 41:
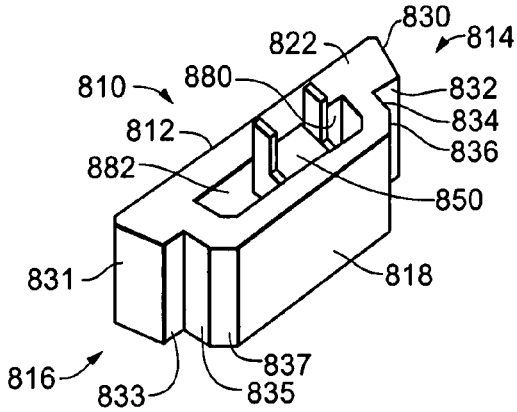
FIG. 41 is a bottom perspective view of an extended width retaining wall block and a clip according to an embodiment of the present invention.
Figure 40:
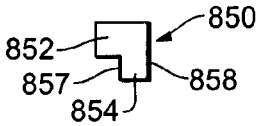
FIG. 40 is a side view of a clip according to an embodiment of the present invention.
Figure 42:
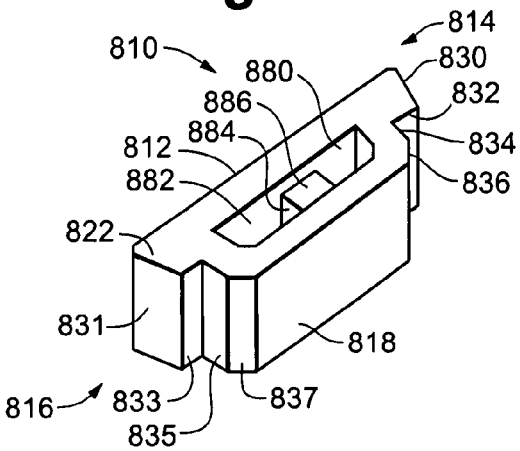
FIG. 42 is a bottom perspective view of an extended width retaining wall block according to an embodiment of the present invention.

An example of a casting or slug 1031 that may be produced by the above mold is shown in FIG. 37. Slug 1031 includes a transverse splitting groove 1033 and a pair of side splitting grooves 1035, 1037. When slug 1031 is split along the splitting grooves, two blocks 1041 and 1051 are formed. Block 1041 includes cores 1043 and 1045 and a projection 1047, while block 1051 is solid and includes only projection 1057. Note that blocks 1041 and 1051 are examples of different types of blocks that may be produced using different stripper shoes (not shown), and that it is understood that any of the blocks disclosed in this application may be manufactured using the above mold. Preferably, blocks produced by the mold box, pallet, and associated stripper shoe will be partially or completely cored so that the blocks produced thereby will have a weight in the range of about 25 to 125 pounds (11 to 57 kg). Such a block can generally be handled by a single person.

When slug 1031 is split along splitter grooves, a roughened texture is imparted to the front surface of each block 1041, 1051 along the face where they were previously joined together. In situations where it might be desirable to produce blocks without a split front surface, such as a smooth surface or a more detailed textured surface, mold box may be provided with one or more divider plates (not shown) extending between projections 1061 and 1063 of sidewalls 1017, 1019 to impart the desired surface finish.

Another embodiment of a block 810 of the present invention a plurality of which, along with one or more intermediate members 850, form an engagement system is shown in FIGS. 38-43. The block 810 is similar to the previously described blocks, except for the lack of downwardly extending projections, and may have a width in the range of about 18-38 inches (45-92 cm), a height in the range of about 4-12 inches (12-31 cm), and a depth in the range of about 4-24 inches (12-61 cm). The block 810 may have a volume that is greater than 288 cubic inches (4.7 liters) or a weight greater than 18 lbs (8.0 kg). Preferably the width and depth dimensions are designed to be wholly divisible into the dimensions of existing mold pallets. For example, it is envisioned that two blocks could be cast on a pallet having a width of around 24 inches and depth of around 18 inches. As with the previously described embodiments, block 810 comprises a front surface 812 and opposing rear surface 818, a top surface 820 and opposing bottom surface 822 and opposing first 814 and second 816 side surfaces.

Each side surface 814, 816 comprises a plurality of sections that are angled with respect to each other. Side surface 814 comprises a first section 830, a second section 832, a third section 834 and a fourth section 836. Similarly, side surface 816 comprises a first section 831, a second section 833, a third section 835, and a fourth section 837. Since the sections of side surfaces 814 and 816 are mirror images of each other, only side surface 814 will be discussed in detail. First section 830 extends generally linearly from the front surface 812 at a generally right angle towards the rear of the block and terminates at the intersection with the second section 832. Second section 832 extends generally linearly towards the center of the block at a generally right angle and terminates at the intersection with third section 834. Third section 834 extends generally linearly towards the rear of the block at a generally right angle and terminates at the intersection with fourth section 836. Fourth section 836 extends generally linearly toward the rear of the block at an angle that terminates at the intersection with rear surface 818.

As with the previously described embodiments, the side surfaces 814, 816 of blocks 810 are configured so that when a plurality of blocks 810 are arranged in a convex course such that the first sections 830, 831 of adjacent blocks are in abutting relation, the size of the vertical joint thereby formed is minimized. The rear surface 818 is therefore about half as wide as the front surface 812. As will be appreciated, this configuration reduces the amount of material needed to manufacture the block, which reduces the overall weight of the block and makes it easier to lift and manipulate.

Block 810 is similar to block 310 in that it may include two cores 880, 882 extending through the block from top surface 820 to bottom surface 822. Cores 820, 822 are separated by a web 884 which serves to strengthen the block. Alternatively, block 810 may be provided with recesses that extend upwardly from the bottom surface and which stop short of the top surface. Web 884 may include a recess 886 at bottom surface 822 to receive a portion of a clip 850, described below.

The intermediate member used to form the engagement system of this embodiment of the present invention is a generally H-shaped clip 850, shown in FIGS. 38-41. Clip 850 is configured to be operatively connected to a block 810 such that at least a portion thereof extends downwardly from the bottom surface 822 of the block 810, with the downwardly extending portion configured to engage at least one rearwardly facing surface of a vertically adjacent block. Clip 850 comprises a first generally L-shaped section having posts 852 and 854 and a generally second L-shaped section having posts 853 and 855 connected to one another by span 856. Posts 852 and 853 are configured to straddle web 884 and posts 854 and 855 extend downwardly from the bottom surface 822 to which the clip 850 is connected. Post 854 and 855 have a smaller width than posts 852 and 853 so that blocks in adjacent courses can be arranged either in substantially vertical courses or with an upwardly receding slope, depending on whether contact edge 857 or contact edge 858 is facing forward.

Figure 43:
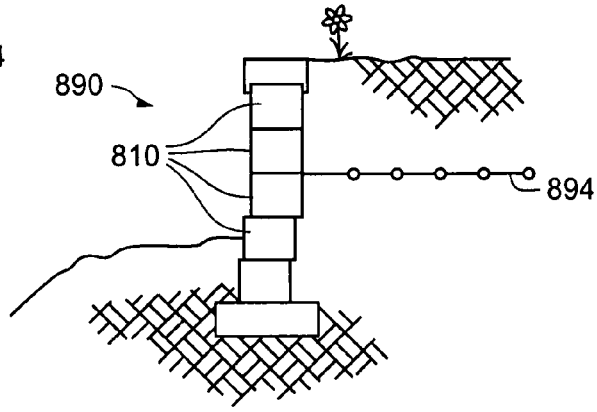
FIG. 43 is a side view of a wall formed of a plurality of extended width retaining wall blocks according to an embodiment of the present invention.

A side view of a wall structure 890 that may be constructed using the above described blocks 810 and clips 850 is depicted in FIG. 43. The wall structure 890 also includes an earth anchor or grid 894. Earth anchor 894 may be operatively connected to the wall structure 890 by looping it over one or more of the downwardly extending posts of clip 850. One of skill in the art will recognize that various types of earth anchors may be used, including a metallic lattice earth anchor and a flexible plastic earth anchor.

Another embodiment of a block 910 of the present invention a plurality of which, along with one or more intermediate members 950, form an engagement system is shown in FIGS. 44-49. The block 910 is similar to the previously described blocks, except for the lack of downwardly extending projections, and may have a width in the range of about 18-38 inches (45-92 cm), a height in the range of about 4-12 inches (12-31 cm), and a depth in the range of about 4-24 inches (12-61 cm). As with the previously described embodiments, block 910 comprises a front surface 912 and opposing rear surface 918, a top surface 920 and opposing bottom surface 922 and opposing first 914 and second 916 side surfaces.

Each side surface 914, 916 comprises a plurality of sections that are angled with respect to each other. Side surface 14 comprises a first section 930, a second section 932, a third section 934 and a fourth section 936. Similarly, side surface 916 comprises a first section 931, a second section 933, a third section 935, and a fourth section 937. Since the sections of side surfaces 914 and 916 are mirror images of each other, only side surface 914 will be discussed in detail. First section 930 extends generally linearly from the front surface 912 at a generally right angle towards the rear of the block and terminates at the intersection with the second section 932. Second section 932 extends generally linearly towards the center of the block at a generally right angle and terminates at the intersection with third section 934. Third section 934 extends generally linearly towards the rear of the block at a generally right angle and terminates at the intersection with fourth section 936. Fourth section 936 extends generally linearly toward the rear of the block at an angle that terminates at the intersection with rear surface 918.

As with the previously described embodiments, the side surfaces 914, 916 of blocks 910 are configured so that when a plurality of blocks 910 are arranged in a convex course such that the first sections 930, 931 of adjacent blocks are in abutting relation, the size of the vertical joint thereby formed is minimized. The rear surface 918 is therefore about half as wide as the front surface 912. As will be appreciated, this configuration reduces the amount of material needed to manufacture the block, which reduces the overall weight of the block and makes it easier to lift and manipulate.

Block 910 is similar to block 310 in that it may include two cores 980, 982 extending through the block from top surface 920 to bottom surface 922. Cores 920, 922 are separated by a web 984 which serves to strengthen the block. Alternatively, block 910 may be provided with recesses that extend upwardly from the bottom surface and which stop short of the top surface.

Figure 44:
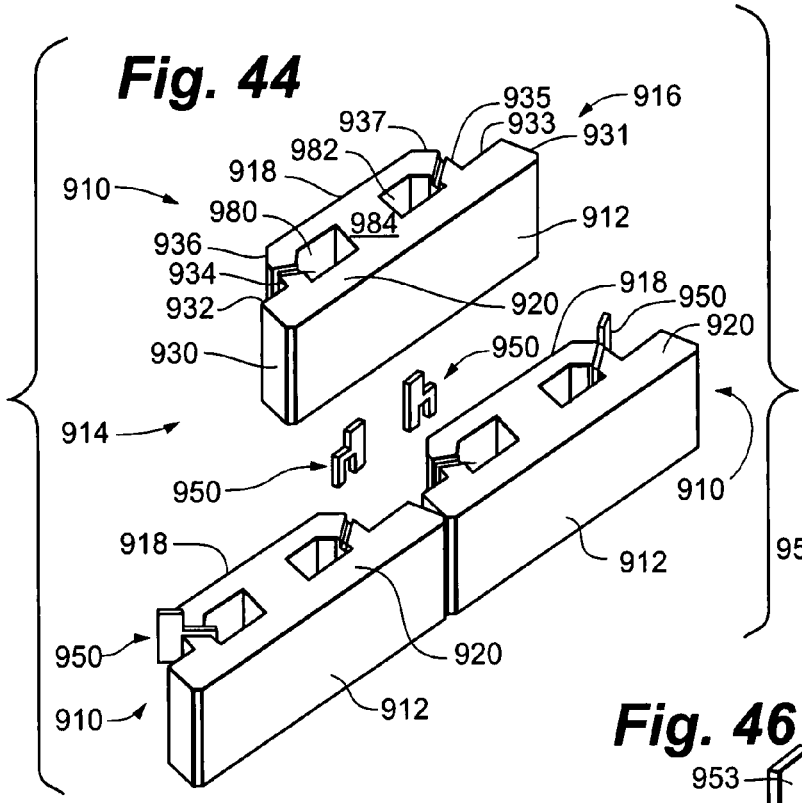
FIG. 44 is perspective view of a plurality of extended width retaining wall blocks and clips according to an embodiment of the present invention.
Figure 45:
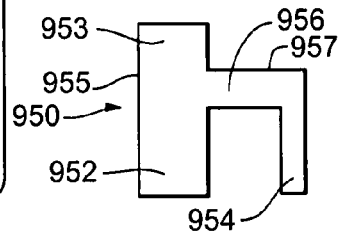
FIG. 45 is a side view of a clip according to an embodiment of the present invention.
Figure 46:
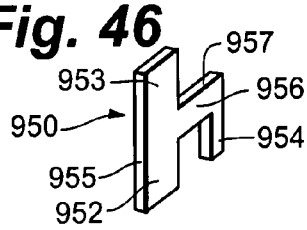
FIG. 46 is a perspective view of a clip according to an embodiment of the present invention.
Figure 47:
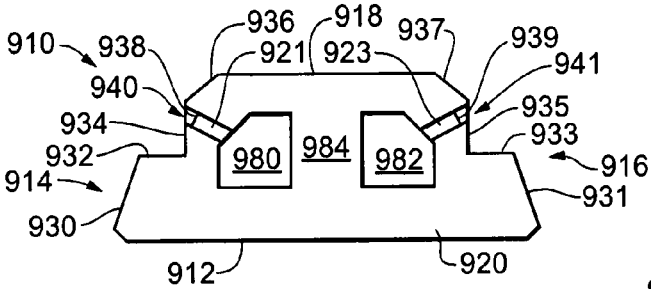
FIG. 47 is a top view of an extended width retaining wall block according to an embodiment of the present invention.
Figure 48:
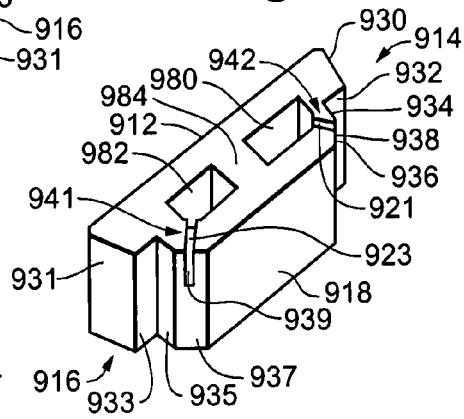
FIG. 48 is a perspective view of an extended width retaining wall block according to an embodiment of the present invention.

The intermediate members that are used to form the engagement system of this embodiment of the present invention are generally h-shaped clips 950, shown in FIGS. 44-46. Clips 950 are configured to be operatively connected to blocks 910 such that a portion of each clip extends upwardly from top surface 920, with each upwardly extending portion configured to engage a forwardly facing surface of a vertically adjacent block. Each clip 950 comprise a first elongated section having posts 952 and 953 and a second elongated section comprising post 954 connected by span 956. Posts 952 and 954 are configured to straddle a portion of the block 910 bounded by the inner surface of a core 980, 982 and the corresponding side surface 914, 916. Post 953 extends upwardly from the top surface 922 of the block. Block 910 may be provided with channels 921, 923 in top surface 920 and channels 938, 939 in side surfaces 914, 916 that form slots 940, 941 that are configured to receive span 956 and post 952, respectively, of clips 950. Preferably, channels 921, 923 are deep enough so that edge 957 is coplanar with top surface 922. Edge 955 of clip 950 is configured to contact a forwardly facing surface of a vertically adjacent block in a wall structure.

Figure 49:
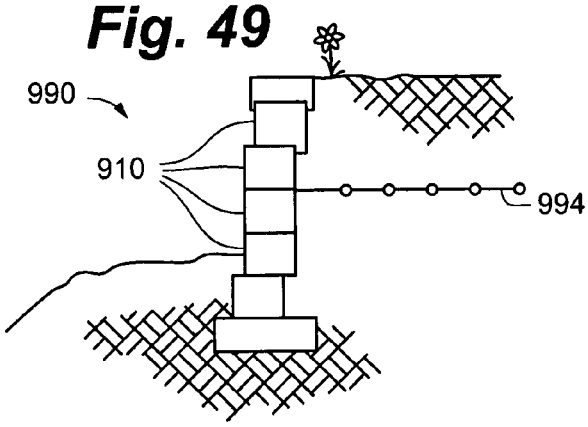
FIG. 49 is a side view of a wall formed of a plurality of extended width retaining wall blocks according to an embodiment of the present invention.

A side view of a wall structure 990 that may be constructed using the above described blocks 910 and clips 950 is depicted in FIG. 49. The wall structure 990 also includes an earth anchor or grid 994. Earth anchor 994 may be operatively connected to the wall structure 990 by looping it over one or more of the upwardly extending posts of clips 950. One of skill in the art will recognize that various types of earth anchors may be used, including a metallic lattice earth anchor and a flexible plastic earth anchor.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A retaining wall block engagement system comprising:

a plurality of wall blocks, each wall block comprising:

a top surface and opposing bottom surface, a front surface and opposing rear surface and first and second opposing side surfaces, wherein the opposing side surfaces do not diverge as they extend rearwardly from the front surface;

a pair of recesses extending upwardly from bottom surface, the recesses separated by a web portion; and a pair of side web portions formed between each recess and each side surface, the side web portions oriented substantially perpendicular to the front surface; and a plurality of generally h-shaped connectors, each connector comprising:

a span portion connected to first and second downwardly extending posts and an upwardly extending post, wherein first downwardly extending post is coplanar with upwardly extending post, and wherein first and second downwardly extending posts are configured to straddle a side web portion of a wall block and upwardly extending post is configured to be received within a recess of a vertically adjacent block.

2. The retaining wall block engagement system of claim 1, wherein each side web portion of each wall block includes a recessed portion for receiving a connector.

3. The retaining wall block engagement system of claim 2, wherein a top surface of each span portion is coplanar with top surface of each wall block when connectors are inserted into recessed portions.

4. The retaining wall block engagement system of claim 1, further comprising an earth anchor operatively connected to the wall block engagement system.

5. The retaining wall block engagement system of claim 4, wherein the earth anchor is connected to the system by looping one or more ends of the earth anchor over one or more upwardly extending posts of one or more connectors.

6. The retaining wall block engagement system of claim 4, wherein the earth anchor is a metallic lattice earth anchor.

7. The retaining wall block engagement system of claim 4, wherein the earth anchor is a flexible plastic earth anchor.

8. The retaining wall block engagement system of claim 1, wherein the recesses extend upwardly from bottom surface through top surface to form cores.

* * * * *